United States Patent [19]

Watts et al.

[11] Patent Number: 5,024,569

[45] Date of Patent: Jun. 18, 1991

[54] STACKING METHOD AND APPARATUS

[75] Inventors: Leonard A. Watts, North Miami Beach; Medardo Espinosa, Hialeah, both of Fla.

[73] Assignee: EDS Technologies, Inc., Hialeah, Fla.

[21] Appl. No.: 876,490

[22] Filed: Jun. 20, 1986

[51] Int. Cl.[5] ..... B65G 57/09; B65H 29/14

[52] U.S. Cl. ..... 414/790.3; 198/431; 198/794; 414/791.2; 414/786

[58] Field of Search ..... 414/31, 47, 48, 790.3, 414/790.4, 791.2, 791.4; 186/794.4; 198/431, 794

[56] References Cited

U.S. PATENT DOCUMENTS

| | | | |
|---|---|---|---|
| 595,239 | 4/1984 | Wiseman . | |
| 1,117,244 | 11/1914 | Richards | 414/31 |
| 3,115,090 | 12/1963 | Elander | 100/215 |
| 3,186,565 | 6/1965 | Williamson | 414/31 |
| 3,292,505 | 12/1966 | Wiseman | 198/422 |
| 3,326,353 | 6/1967 | Murchison et al. | 198/628 |
| 3,379,320 | 4/1968 | Loach et al. | 414/31 |
| 3,418,895 | 12/1968 | Palmer | 414/45 |
| 3,450,275 | 6/1969 | Carlen, Jr. | 414/31 |
| 3,479,932 | 11/1969 | Stal et al. . | |
| 3,526,170 | 9/1970 | Oderman et al. . | |
| 3,548,995 | 12/1970 | Oderman et al. | 198/794 X |
| 3,568,815 | 3/1971 | Wiseman . | |
| 3,596,779 | 8/1971 | Osteen . | |
| 3,611,887 | 10/1971 | Shibanuma et al. . | |
| 3,752,043 | 8/1973 | Rapparlie et al. | 414/794.4 X |
| 3,831,505 | 8/1974 | Skogsberg | 414/794.4 X |
| 3,908,985 | 9/1975 | Wiseman | 271/189 |
| 4,037,525 | 7/1977 | Sjogren et al. | 414/50 |
| 4,055,245 | 10/1977 | Sundberg | 414/31 |
| 4,068,567 | 1/1978 | Allison et al. | 414/31 |
| 4,103,785 | 8/1978 | Wiseman | 414/31 |
| 4,125,253 | 11/1978 | Wangermann | 414/790.4 X |
| 4,148,393 | 4/1979 | Wiseman | 198/503 |
| 4,162,733 | 7/1979 | Wiseman | 414/78 |
| 4,421,221 | 12/1983 | Pessina et al. | 198/372 |
| 4,678,387 | 7/1987 | Sjogren et al. | 414/47 |

FOREIGN PATENT DOCUMENTS

| | | |
|---|---|---|
| 1253170 | 10/1967 | Fed. Rep. of Germany . |
| 488616 | 4/1970 | Switzerland . |
| 567996 | 10/1975 | Switzerland . |

*Primary Examiner*—Robert J. Spar
*Assistant Examiner*—Janice Krizek
*Attorney, Agent, or Firm*—Finnegan, Henderson, Farabow, Garrett & Dunner

[57] ABSTRACT

A self-adaptive stacker comprising infeed and stacking sections whose movement is coordinated to provide interception of the signature stream. A microprocessor utilizes a signal, representative of the infeed conveyor speed, together with a signal from a signature counter, to track the movement of each signature and thereby its arrival at the intercept position. Low armature inertia motors drive the three axes, (stacking section, the turntable, and the ejectors) to provide rapid starting, acceleration, deceleration, and stopping at selected positions. These motors are controlled to interact in real-time in order to adapt the three axes to the rate of the incoming signatures. The movement of the signature carriers is altered, when necessary, due to speed changes of the signature stream. A sensor located at the intercept ready position detects the passage of a signature carrier to initiate acceleration of the signature carrier by an amount which is a function principally of signature thickness, velocity, and separation distance to control the amount of acceleration required to move the carrier beneath the first signature of the next stack to be formed. A turntable section forms compensated bundles by rotating a platform. A pusher assembly is mounted beneath the rotatable turntable platform and includes pusher bars arranged by linkage members to move precisely along the path of the drive chain to enhance monitoring, control and movement of the push rods. A sensor senses the passage of a push rod to detect the initial movement and subsequent thereto the arrival of a push rod to the home position.

66 Claims, 19 Drawing Sheets

STACKING METHOD AND APPARATUS

FIELD OF THE INVENTION

The present invention relates to signature stacking; and more particularly, to a method and apparatus for counting and stacking signatures and forming bundles.

BACKGROUND OF THE INVENTION

Stackers are typically employed to form signature bundles of a predetermined count and must be capable of operating at speeds which permit the counting and stacking of signatures without the necessity for any reduction in the speed of the press conveyor delivering signatures to the stacker, at speeds of up to and even greater than 80,000 per hour.

Conventional designs typically utilize drives and/or mechanisms, such as clutches and brakes which abruptly stop and start the stacking section and/or require physical stops or other members which are movable into and out of the path of the stacking apparatus, thus resulting in undue and hence premature wearing and even breakage of stacker components, in addition to the significant amount of noise generated by such conventional equipment.

SUMMARY OF THE INVENTION

An object of the present invention is to provide an improved method and apparatus for stacking signatures where the three axes (stacking section, turntable, and ejector) rapidly adapt to the rate of speed of the incoming product.

Another object of the present invention is to provide a method and apparatus for stacking signatures that responds rapidly to changing operational requirements.

Another object of the present invention is to provide a stacker which is durable, provides smooth and quiet operation and is simple in design in order to reduce both stacker complexity, and the wearing and damage to stacker components.

Another object of the present invention is to provide an improved stacking apparatus that is so constructed to facilitate inspection, maintenance and replacement, as well as initial inspection.

Another object of the present invention is to provide an apparatus and method for stacking signatures having means to facilitate their handling and stacking.

A further object of the present invention is to provide a signature stacker signature support having means for assuring precise intercept of the stream and stacking of the signature.

Still another object of the present invention is to provide a signature stacker capable of detecting the presence of a jam, and for halting and reversing the operation of the stacker, without injury to components thereof.

Still another object of the present invention is to provide a signature stacker that is so constructed to prevent the accumulation of dust and dirt therein.

Additional objects and advantages of the invention will be set forth in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method is provided for stacking signatures into a plurality of individual bundles wherein the signatures are conveyed by an infeed conveyor to a turntable where they are stacked by a stacking means into individual bundles, and each individual bundle is ejected from the turntable in turn after stacking by push rods, the method comprising operating the infeed conveyor at a selected speed, and operating the stacking means, the turntable, and the push rods at a speed which is a function of the rate of speed of signatures delivered by the conveyor to the stacking means.

In another aspect, a method is provided for stacking signatures delivered in a stream by a conveyor to an infeed conveyor to a stacking means, comprising:detecting the speed of the conveyor; detecting the speed of the infeed conveyor; counting each signature as it reaches a predetermined position; operating the stacking means at a controlled speed to an intercept position; regulating the speed of the infeed conveyor means, controlling the speed of the stacking means to reach the intercept position at the same time as a selected signature to be collected on the stacking means reaches the position in accordance with the detected speed of the infeed conveyor and the signature counts.

In another aspect of the invention, apparatus for stacking signatures delivered thereto in a stream by a conveyor comprises: stacking means for stacking signatures; an infeed conveyor means operative to deliver at a controllable speed a signature stream delivered thereto by the conveyor to stacking means; means for generating signals representing the conveyor speed, means for regulating the speed of said infeed conveyor means; means coupled to the infeed conveyor means for generating infeed speed signals representing the speed of the infeed conveyor means; signature counting means for generating a count signal as each signature reaches a predetermined position, means for operating said stacking means at a controlled speed to an intercept position; and computer means responsive to the count signals and the infeed speed signals for controlling the speed of the stacking means to reach the intercept position at times when a selected signature to be collected on the stacking means reaches the intercept position.

In another aspect of the invention, a method is provided for guiding signatures arranged in an overlapping stream to a stacking station, comprising receiving the stream at an upstream end and delivering the stream to the stacking station from the downstream end; compressing the signature stream as it passes from the upstream to the downstream end; and urging the stream into a V-shaped configuration adjacent the downstream end.

In still another aspect, apparatus is provided for guiding a signature stream, to a stacking apparatus, comprising first and second stream guide means for receiving the stream at an upstream end and delivering the stream to the stacking apparatus from a downstream end; the first and second guide means each including cooperating upstream and downstream compressing means for compressing the signature stream; and urging means for urging signatures passing between said downstream compressing means into a substantially V-shaped configuration.

In still another aspect, a turntable assembly comprises a turntable; a push rod drive assembly; turntable drive means for rotating the turntable; cam means rotatable with the turntable, the cam means having lobes; plural sensing means positioned at spaced intervals about the cam means; each sensing means generating a signal when one of the lobes passes the sensing means; and means responsive to the signals for detecting movement of the turntable.

In yet another aspect, the stacking apparatus comprises a closed loop drive chain assembly; a plurality of stacking supports pivotally coupled at spaced intervals to the drive chain assembly for receiving signatures; each stacking support including means for periodically interrupting the signature stream; and means for guiding the stacking supports along a closed loop path.

In a still further aspect, a moving seal assembly for a slot in a support surface comprises a plurality of links pivotally connected end-to-end resting upon the surface above the slot; at least some of the links having a pivotally connected roller disposed within the slot; a plurality of discs being disposed on the underside of the slot and being coupled to the pivoted connections of selected ones of the links; and a pushrod extending upwardly through the slot and a plurality of links for serving as the pivotal coupling for the links.

In a still further aspect, the signature handling means comprises a platform for receiving a stack of signatures; the platform having a guide slot; ejector driving means comprising a closed loop driving member arranged beneath the guide slot, at least one elongated arm extending upwardly through the guide slot and having its lower end coupled to the ejector driving means at a predetermined location along the closed loop drive member; flexible sealing means arranged in the slot; means coupling the sealing means to the ejector arm for moving the sealing means along the guide slot together with the ejector arm, providing a moving seal for preventing foreign matter from entering the guide slot; and the sealing means being capable of sealing curved portions of the guide slot through which it moves.

DETAILED DESCRIPTION OF THE PREFERRED EMBODIMENT

Figure 1:
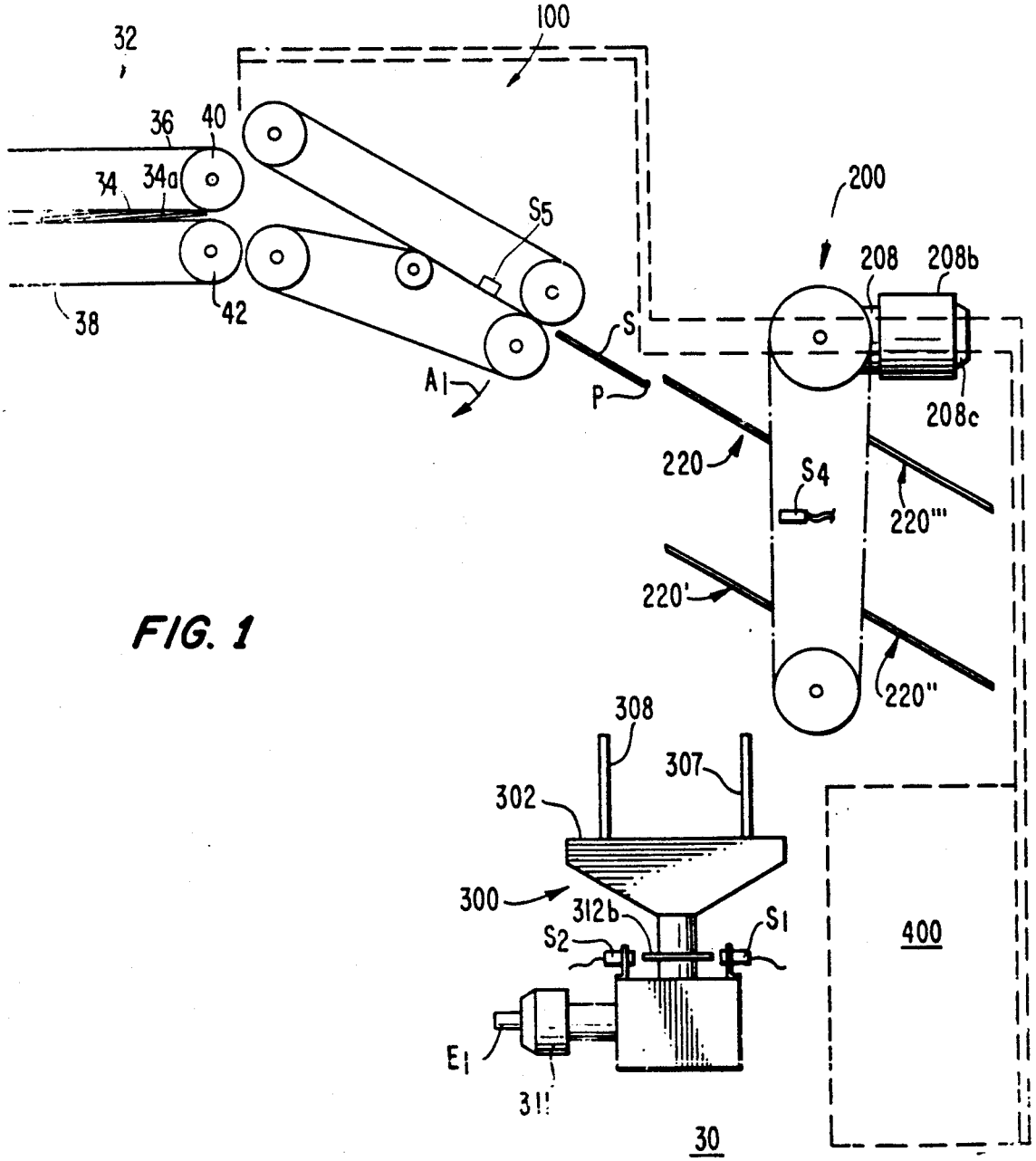
FIG. 1 shows a simplified schematic left side elevational view of a signature stacker in accordance with the present preferred embodiment of the invention.

Stacker 30 of the present invention shown in FIG. 1 comprises infeed section 100, stacking section or batcher 200, turntable section 300 and control section 400. Infeed section 100 is coupled to a press conveyor, or other up-stream conveyor means, by means not shown but which are conventional and have been omitted herein for purposes of simplicity, said coupling means aligning and coupling infeed section 100 with delivery conveyor 32 which delivers signatures 34 in an overlapping stream with folded edges **34*a* forward (see FIG. 1). The stream of overlapping signatures 34 which may be delivered to the stacker 30 at rates of as many as 80,000 per hour or more, is fed between upper and lower conveyor belts 36 and 38 respectively only a portion of which have been shown herein for purposes of simplicity, the downstream ends of said conveyor belts 36 and 38 being entrained about rollers 40 and 42 arranged adjacent to the inlet end of infeed section 100**.

Noting especially FIGS. 2 to 7, which show the infeed section 100 in greater detail, said section comprises side plates 101, 103 which are maintained in spaced parallel fashion by spacers 102 and 104, among other components. Left-hand ends 101*a*, 103*a* of plates 101, 103 are provided with openings for securing plates 101, 103 to the stacker supporting frame by suitable fastening means.

Figure 3:
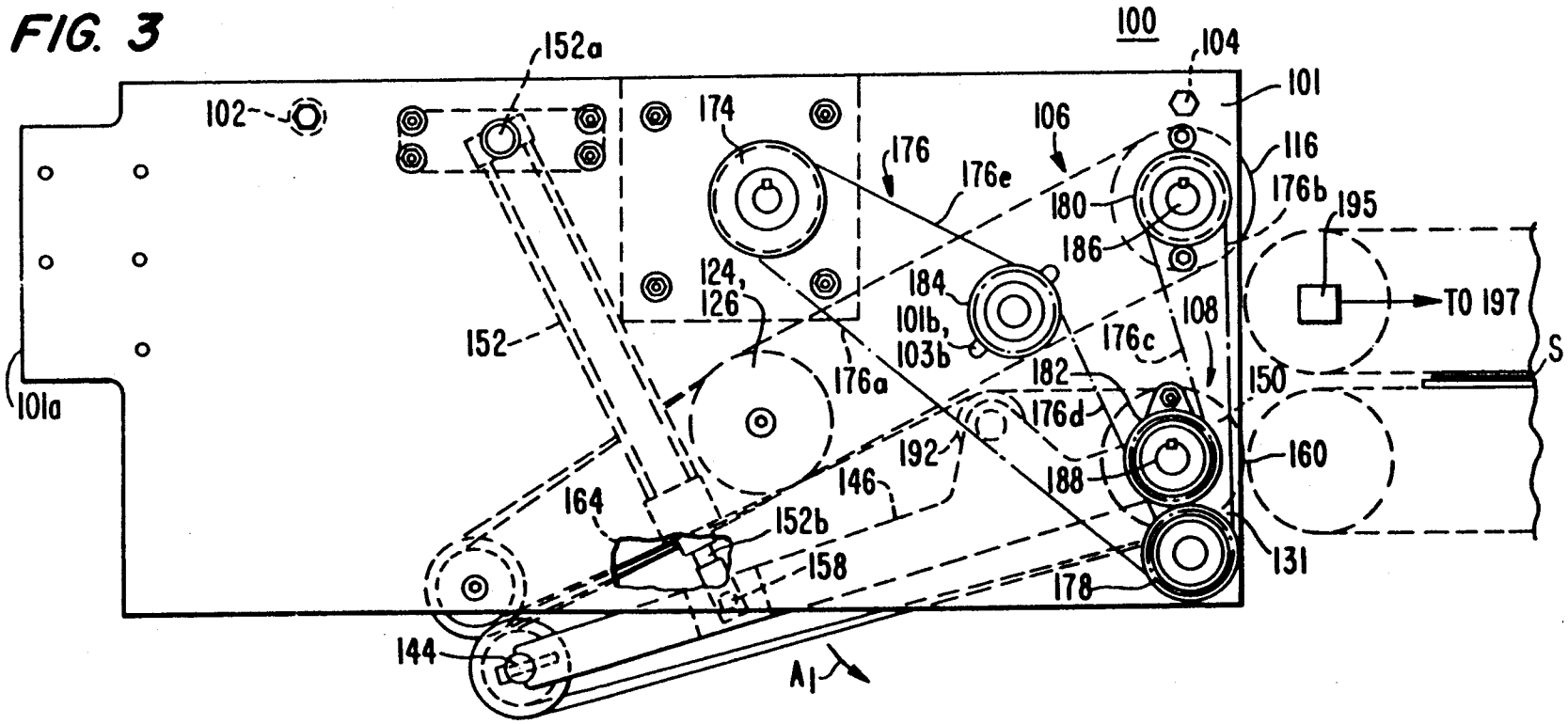
FIG. 3 is an elevational view of the infeed section of FIG. 2.

Referring to FIG. 3, the inlet end of infeed section 100 has a throat portion T for receiving signatures from the adjacent conveyor, which throat portion, as well as the signature feeding portion, is defined by upper and lower belt assemblies 106 and 108.

Figure 2:
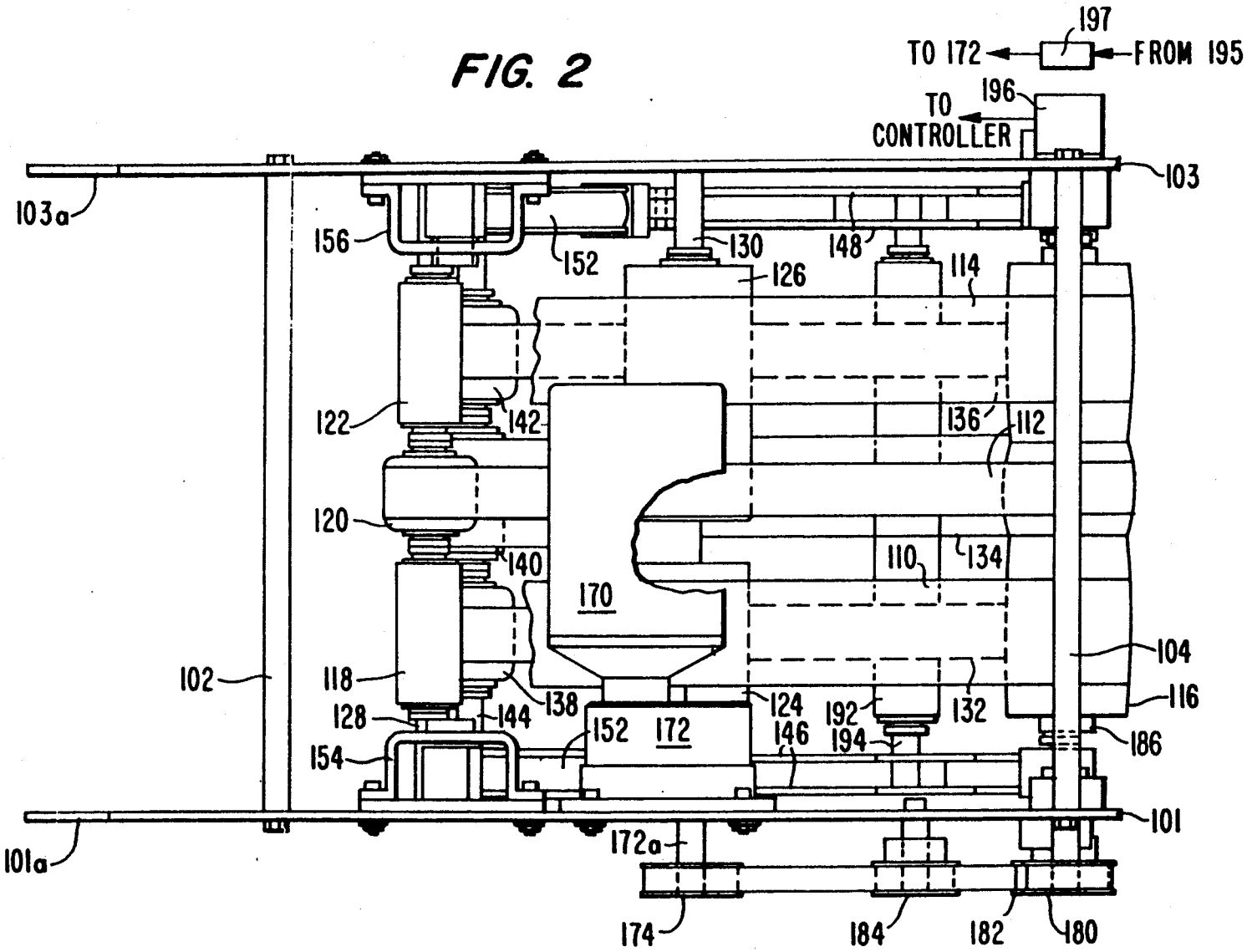
FIG. 2 is a fragmentary top plan view of the stacker shown in FIG. 1 illustrating the infeed section thereof in accordance with the present preferred embodiment of the invention.
Figure 4:
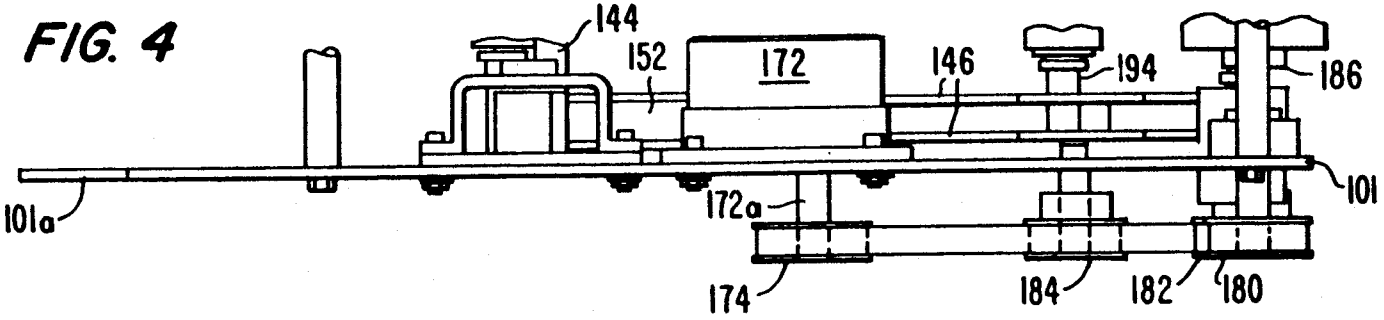
FIG. 4 is a fragmentary top plan view illustrating a portion of the infeed section of FIGS. 2 and 3.

As clearly shown in FIG. 2 upper belt assembly 106 comprises belts 110, 112, and 114 which are entrained about upstream roller 116, downstream rollers 118, 120, and 122, and intermediate rollers 124, 126. An intermediate roller assembly, including roller 126, supports the intermediate portion of belts 112 and 114. Rollers 124 and 126 are mounted upon common shaft 130. Rollers 118, 120 and 122 are mounted upon common shaft 128.

Lower belt assembly 108 includes roller 131 about which the upstream ends of belts 132, 134 and 136 are entrained. The downstream ends of these belts are entrained about rollers 138, 140, and 142 mounted upon common shaft 144 which is mounted at the free ends of swingable arm assemblies 146, 148 which are swingably mounted about pivot 150. A pair of air cylinders 152, 152 are pivotally mounted at their upper ends 152*a* to a bearing supporting bracket assembly 154, 156. The free end of each reciprocating piston rod 152*b* is coupled to one of the swingable arm assemblies 146, 148 by pin 158. Referring to FIG. 3, suitable ports, not shown for simplicity, provide for the ingress and egress of gas under pressure for moving piston rods 152*b*, 152*b* generally upwardly to retain the lower belt assembly 108 in the operative position shown in FIG. 3 and alternatively for moving the piston rods 152*b*, 152*b* generally downwardly to swing arm assemblies 146, 148 counterclockwise about pivot 150 as shown by arrow A1, to move the free ends of arm assemblies 146, 148 and thereby move rollers 138, 140, and 142 away from the cooperating rollers 118, 120, and 122. The swingable assemblies 146, 148 and air cylinders 152, 152 serve as a drop gate which, under certain circumstances, serve to prevent the flow of signatures to the stacking section when the drop gate assembly is open, enabling the signatures to fall harmlessly upon the floor and thereby prevent the signatures from aggravating a jam condition in the stacker 30.

Figure 5:
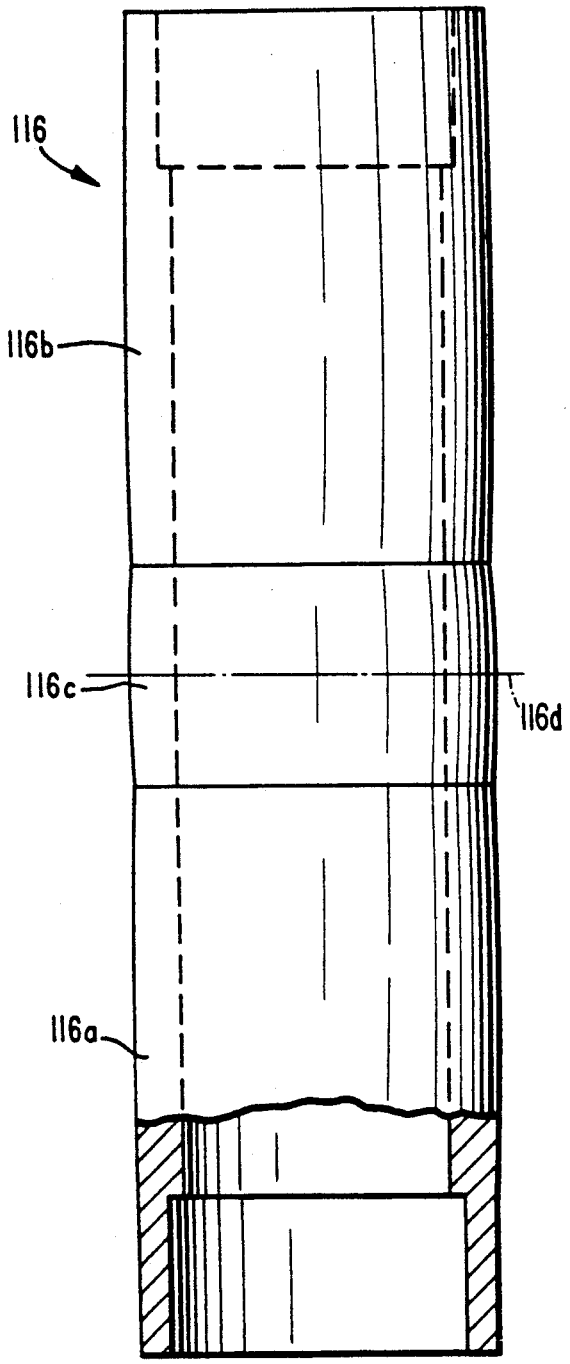
FIGS. 5 and 6, both partially sectionalized, show views of the upper and lower drive rollers, respectively, of the infeed section of FIGS. 2 and 3.

Upper drive roller 116, shown in FIGS. 3 and 5 is a substantially hollow member and is crowned at 116*a* and 116*b* for receiving and supporting belts 110 and 114 and for maintaining these belts centered upon crown regions 116*a* and 116*b* (see FIG. 5). A centrally located crown 116*c* receives and positions belt 112 and maintains it centered about center line 116*d*. As can be seen from FIG. 2, belts 110 and 114 are substantially wider than belt 112.

Figure 6:
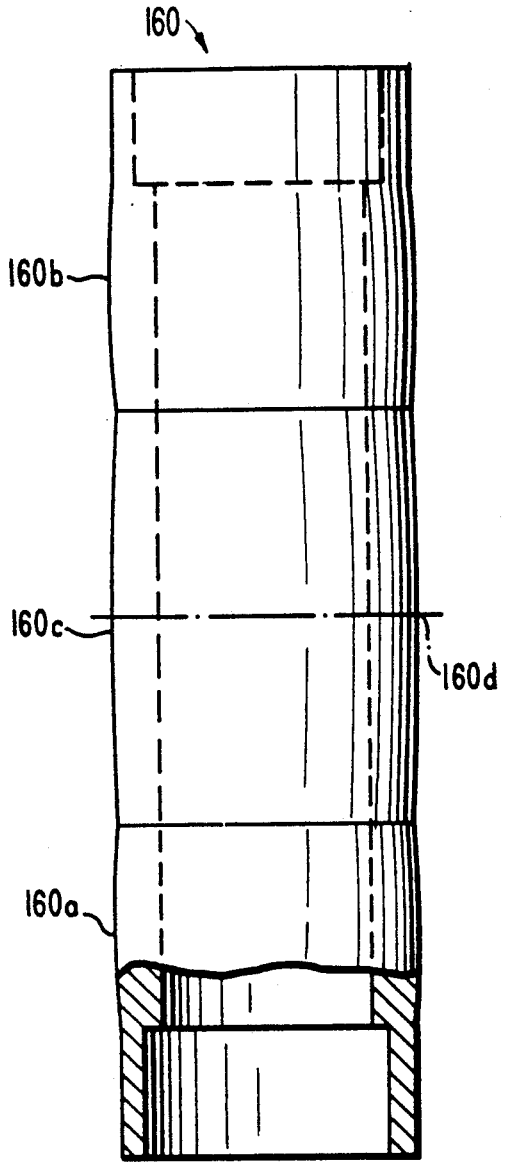

FIG. 6 shows lower drive roller 160 which is crowned at 160*a* and 160*b* to receive and support belts 132 and 136 and which maintain these belts centered on the aforesaid crowns. A centrally located crown 160*c* having a significantly greater radius of curvature receives and supports belt 134 and maintains it centered about centerline 160*d*. Belt 134 is significantly wider than belts 132 and 136. It is further to be noted that belts 132, 136, and 112 are all substantially the same width and are significantly narrower than belts 110, 114, and 134 which are all substantially the same width and hence significantly wider than belts 112, 132, and 136.

Upper belts 110 and 114 have their lower ends entrained about rollers 118 and 122 which are crowned in the same manner as roller portions 116*a* and 116*b* of upper drive roller 116. The downstream end of upper belt 112 is entrained about roller 120 which is crowned in a manner similar to the crown 116*c* provided at the central portion of roller 116 shown in detail in FIG. 5.

Upper rollers 118 and 122 have substantially the same diameter and axial length. These rollers are significantly longer and smaller in diameter than roller 120. Conversely, lower driven rollers 138 and 142, which are of the same diameter and axial length, are significantly greater in diameter and shorter in axial length than lower driven roller 140.

Figure 7:
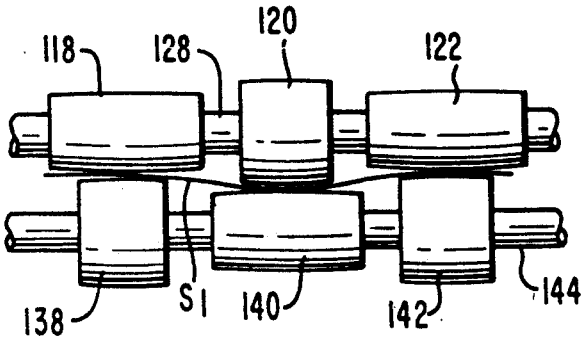
FIG. 7 is a fragmentary schematic view in elevation of the infeed section of FIG. 2 illustrating the downstream roller assembly.

The unique arrangement of rollers 118 through 122 and 138 through 142 can best be appreciated from a consideration of the simplified elevational view of these rollers shown in FIG. 7. The axial length of rollers 118 and 122 are each significantly greater than the axial length of rollers 138 and 142. On the other hand, the diameters of rollers 118 and 122 are significantly smaller than the diameters of rollers 138 and 142. Roller 120 has a shorter axial length and a greater diameter than roller 140. The rollers 120, 138, 142 at the downstream end of the infeed section 100 are preferably rounded at their ends. The diameters and axial length of the aforementioned downstream driven rollers serves to urge the signatures into a substantially V-shaped contour as shown by signature S' in FIG. 7. The advantages of urging the signatures into a Veed contour, which advantages are well known in the signature handling and stacking art, reside in the fact that signatures are much easier to handle and feed due to the fact that Veed contour stiffens the signatures to obtain these advantageous handling characteristics. The unique aspect of the present invention resides in the fact that the conventional technique for obtaining Veeing of the signatures requires the provision of split shafts for both the upper and lower driven roller assemblies and mounting rollers of substantially uniform diameter and axial length upon the Veed shaft portions. In addition, in the conventional arrangement, the rollers do not engage the signatures at the imaginary center line of the signatures. The unique arrangement of the present invention, which employs straight, parallel shafts 128 and 144 and rollers of varying diameter and axial length, provides for the Veeing of signatures as well as providing an arrangemeant in which rollers 120 and 140 and hence the belts 112 and 134 entrained therearound make rolling engagement with each signature along the center line of the Veed configuration, thus assuring better alignment and feeding of the signatures.

As the signatures pass through infeed section 100, their forward folded edges pass a signature counter 164 (see FIG. 3) which may be any conventional signature counter employed to count passing signatures by developing a pulse as the nose of each signature passes the signature counter. The signature counter 164 may, for example, be a mechanical device having a gear-like member which is advanced by a fraction of a revolution each time it is engaged by the forward folded edge of a signature which rotates the gear-like member through said fraction of a revolution to provide a count pulse. Although the signature counter may utilize other techniques such as optical or photoelectric techniques to generate a pulse as the forward folded edge of each signature passes the signature counter, a signature detector and counter of the acoustic type as described in copending application Ser. No. 876,486 filed in the U.S. Patent and Trademark Office concurrently herewith and assigned to a common assignee may be used. The output pulses of the signature counter are utilized in the signature counting and stacking operations, typically in the following manner:

Knowing the geometry of the stacker apparatus 30 and given the velocity of the signatures at any given time, the precise moment when the leading edge of a signature reaches the intercept position can be accurately calculated. Each of the aforesaid pulses generated by the signature counter are applied to the microprocessor-base controller 400 (FIG. 1) to determine when the signature, after moving from the position where it is counted by signature counter 164, reaches a predetermined position, such as, for example, the intercept position, which will be described in greater detail hereinbelow.

The infeed section 100 further comprises a motor and gear reducer 172 for driving pulley 174 mounted upon the output shaft 172*a* of gear reducer 172. A double sided pulley belt 176, represented by a chain line, is entrained about timing pulleys in such a way that run 176*a* extends between pulley 174 and pulley 178, run 176*b* extends between pulleys 178 and 180; run 176*c* extends between pulley 180 and pulley 182; run 176*d* extends between pulley 182 and idler pulley 184; and run 176*e* extends between idler pulley 184 and pulley 174. Pulleys 180 and 182 are respectively coupled to shafts 186 and 188 for respectively rotating the upper and lower drive rollers 116 and 160. Pulley 184 may be adjustably positioned along slots 101*b*, 103*b* to adjust the tension on belt 176.

Aforementioned throat region T which serves to guide signatures delivered from the press conveyor, has a substantially V-shaped throat portion, which is defined by the right-hand end of the lower run of belts 110, 112, and 114 which are diagonally aligned as shown in FIG. 3, as well as the right-hand portion of the upper run of belts 132, 134, and 136 and specifically the portion of the upper run of these belts extending between roller 160 and an intermediate roller 192 mounted for freewheeling rotation upon shaft 194 which in turn is supported by the swingable arms 146 and 148 (see FIGS. 2 and 3). The signatures are ultimately firmly gripped between the upper and lower belt runs as their forward folded edges pass over the portion of the belts 132 and 134 and 136 extending around roller 192. As the signatures move to the left of the last-mentioned position, they are firmly secured between the upper and lower belt runs and are moved at the linear speed of said belts, also taking into account any possible slippage normally encountered between the belts and the signatures passing therebetween.

The belts are moved at a linear speed which corresponds to the linear speed of the belts 36, 38 employed to deliver the signatures to the infeed section 100 by the press conveyor 32 (FIG. 1). A tachometer generator 195 (FIG. 3) is coupled, for example, to the shaft of the press conveyor upper driving roller 40 for developing a voltage level proportional to speed generated by tachometer generator 195, said pulses representing the linear speed of the press conveyor belts and hence the signatures passing therethrough. These voltage levels are coupled through an electrical interface 197 (see FIG. 2) forming part of the stacker 30 electronics which is coupled to control motor 172 and its gear reducer unit which determines the rotational speed of the roller shafts 186 and 188 and hence the rotating speed of the upper and lower drive rollers 116 and 160. A tachometer 196 is coupled to shaft 186 and generates pulses as shaft 186 rotates, said pulses representing the linear speed of the belts 110, 112, and 114. The pulses from tachometer 196 are utilized by the stacker controller in the tracking of signatures, as will be more fully described hereinbelow.

Figure 9:
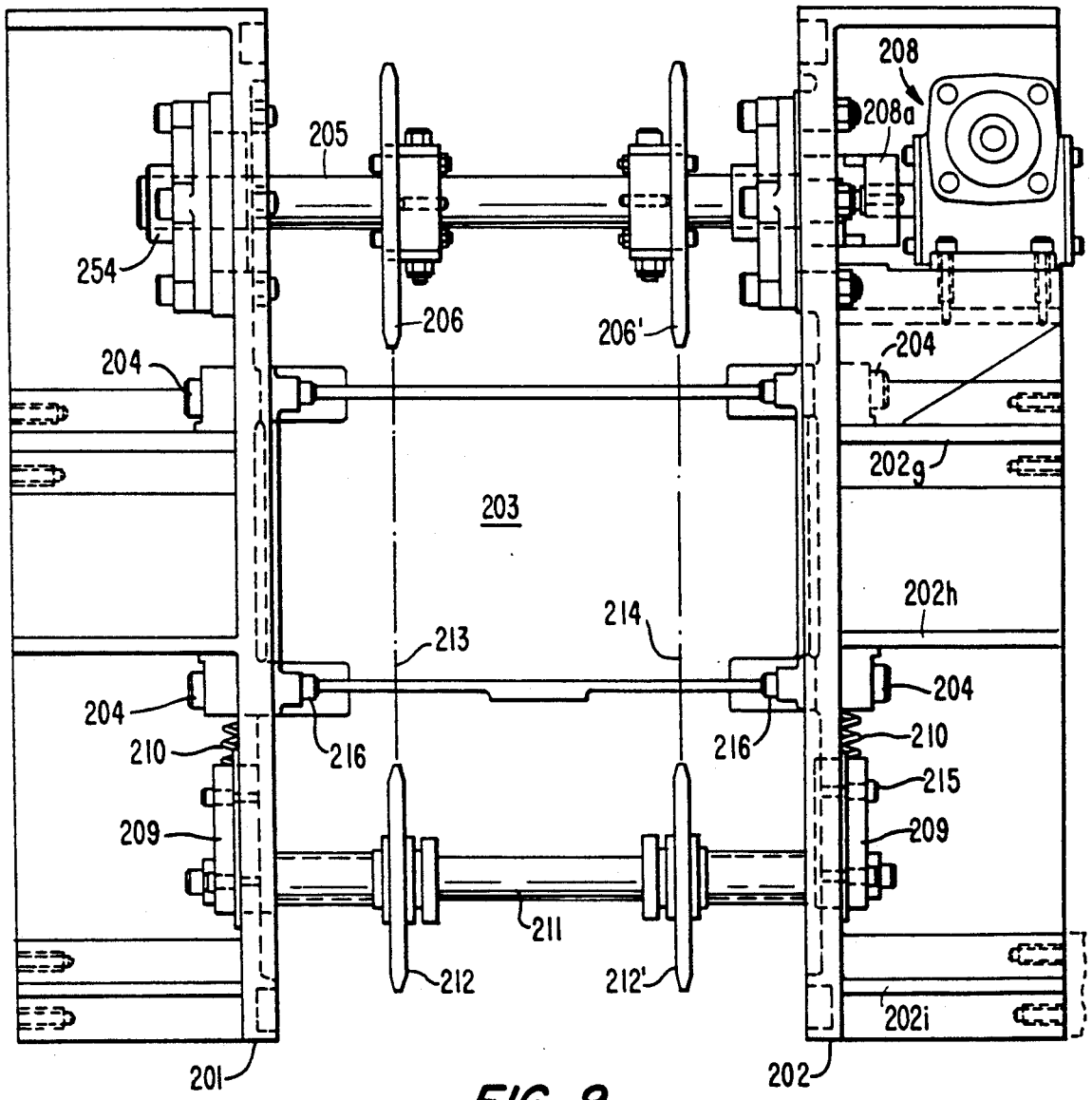
FIG. 9 is a fragmentary front elevation of the stacking section employed in the stacker of FIG. 1 in accordance with the present preferred embodiment of the invention with the stacking supports being omitted for purposes of clarity.

FIG. 9 shows stacking section 200 comprising of a pair of side frames 201 and 202 which, in addition to rotatably supporting the drive and driven sprockets, further incorporate guide channels which guide the signature supports which collect the signatures in the form of signature stacks of an accurate, predetermined count.

Figure 15:
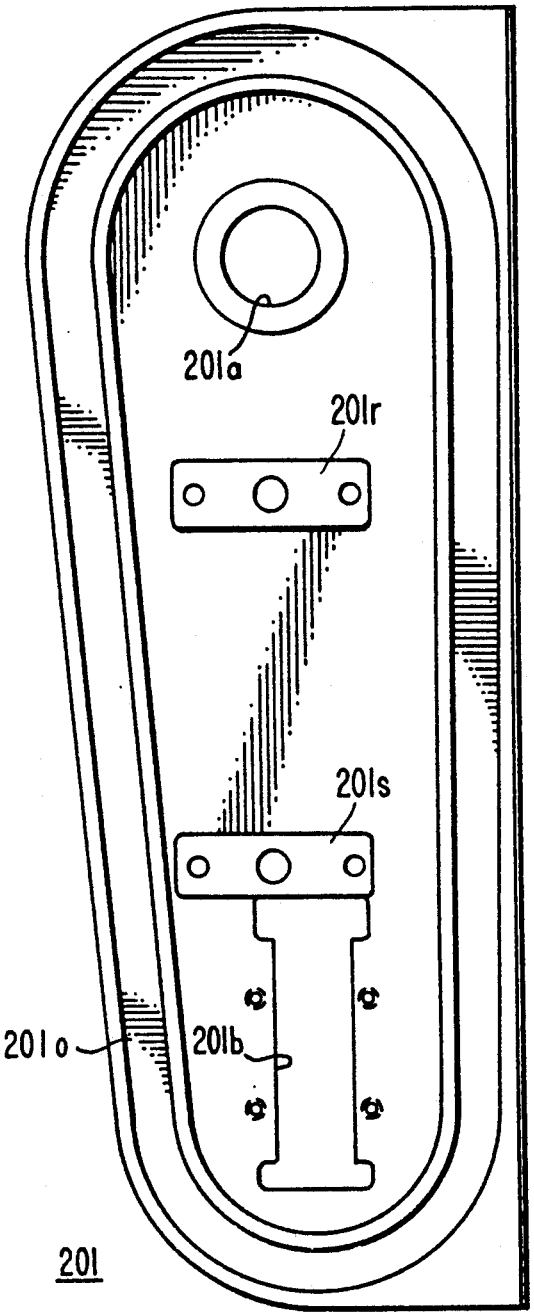
FIG. 15 is a right side elevational view of the left-hand side frame as viewed in FIG. 9 of the stacking section.
Figure 16:
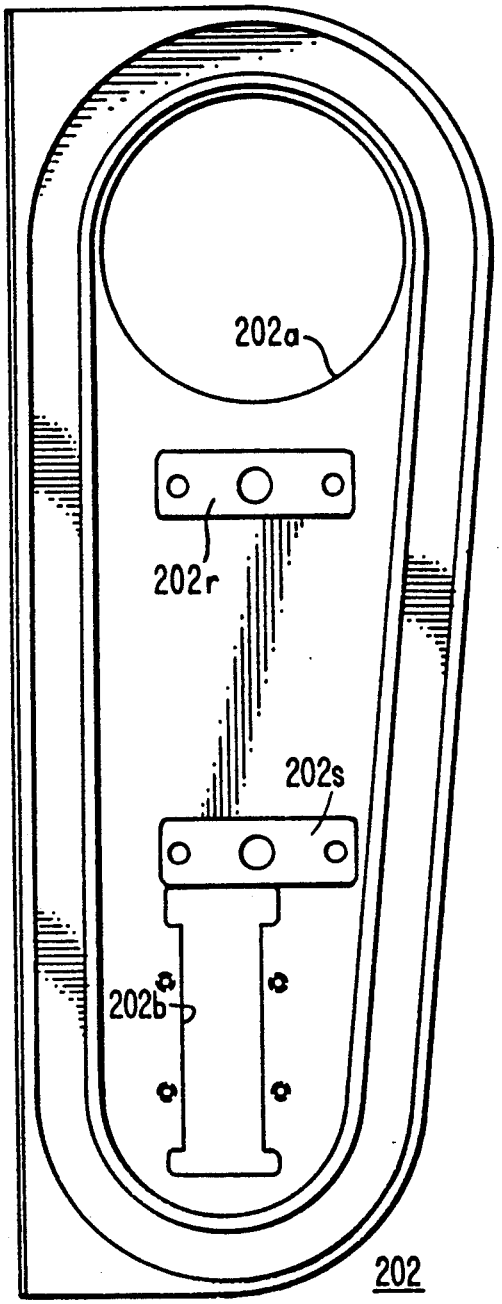
FIG. 16 is a left side elevational view of the right-hand side frame of the stacking section as viewed in FIG. 9.
Figure 17:
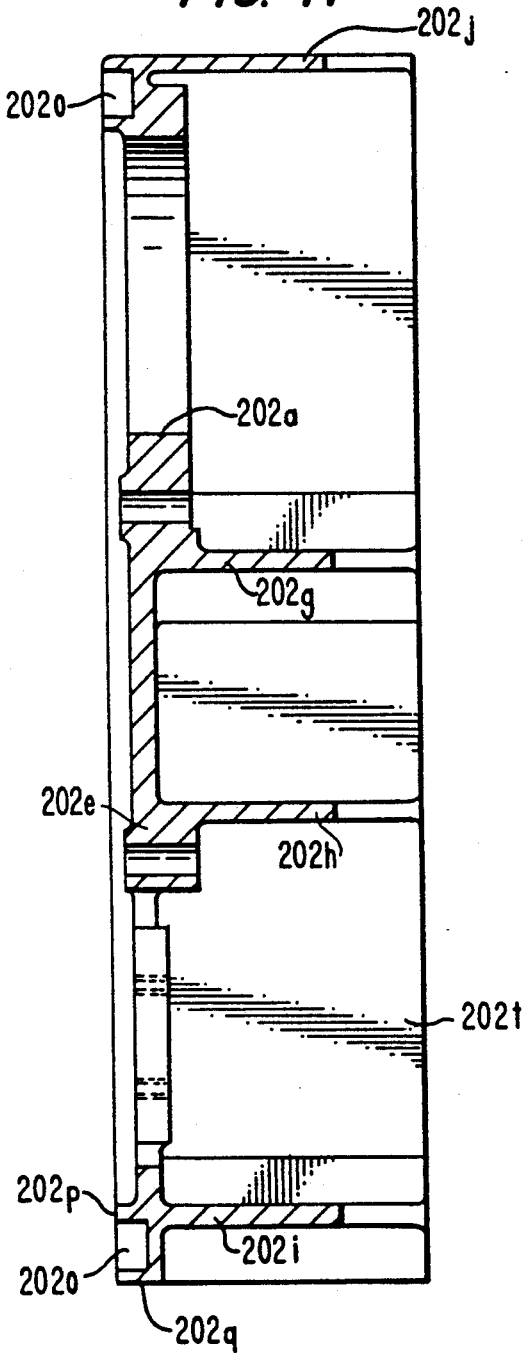
FIG. 17 is a sectional view in elevation of the right-hand side frame as viewed in FIG. 9 of the stacking section.

A casting 203 having an I-shaped cross-section is positioned between a left- and right-hand frames 201 and 202 which are secured to casting 203 by fasteners 204 to maintain the left- and right-hand frames 201 and 202 in spaced parallel fashion. The upper and lower flanges of casting 203 rest upon mounting surfaces 202*r*, 202*s* of side frame 202 (FIG. 16) and 201*r*, 201*s* of side frame 201 (FIG. 15).

Figure 13:
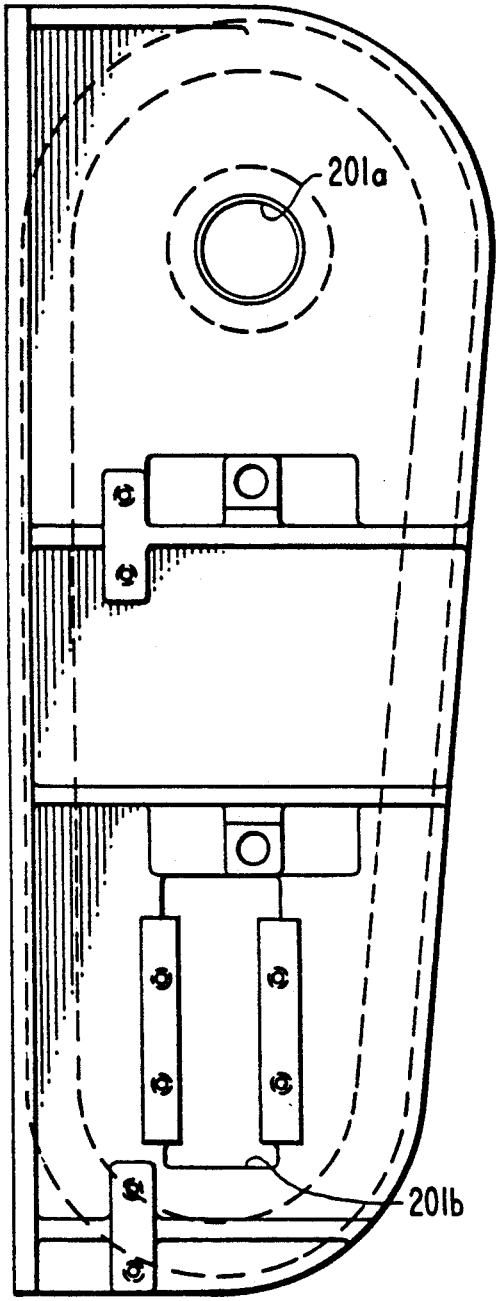
FIG. 13 is a left side view of the left-hand side frame of the stacking section as viewed in FIG. 9.
Figure 14:
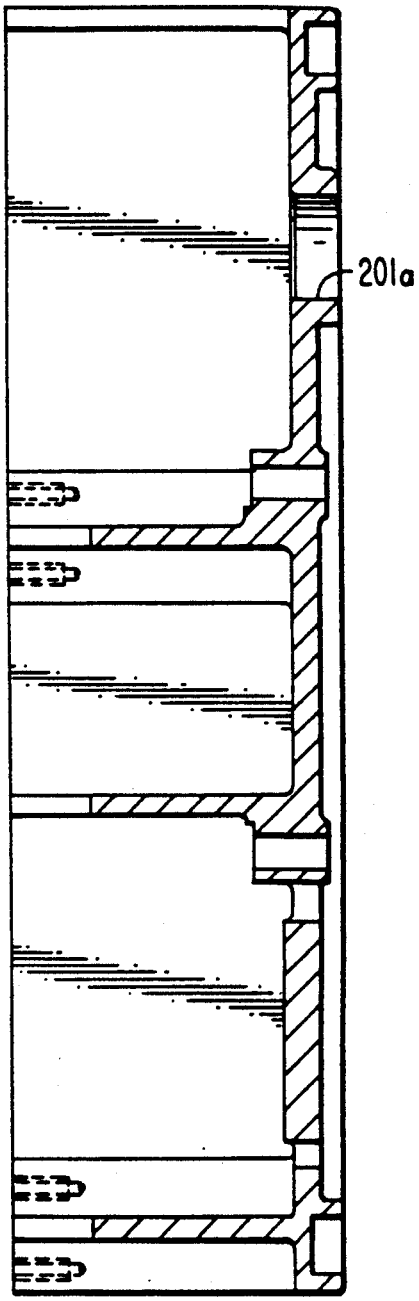
FIG. 14 is a sectional view of the left-hand side frame as viewed in FIG. 9 of the stacking section.

The right-hand frame 202 shown in detail in FIGS. 16 through 19 is provided with an upper opening 202*a* for supporting a bearing 254 which rotatably supports the left-hand end, of shaft 205 which supports upper drive sprockets 206 and 206'. The left-hand side frame 201 shown in detail in FIGS. 13 to 15 is provided with an upper opening 201*a* of small diameter for receiving and supporting the bearing for the opposite end of shaft 205. A coupling 208*a* couples a gear reducer to the shaft 205. A motor 208*b* (FIG. 1) is coupled to gear reducer 208. An encoder 208*c* is coupled to motor 208*b* and generates pulses representing linear movement of the signature supports to be more fully described.

Figure 18:
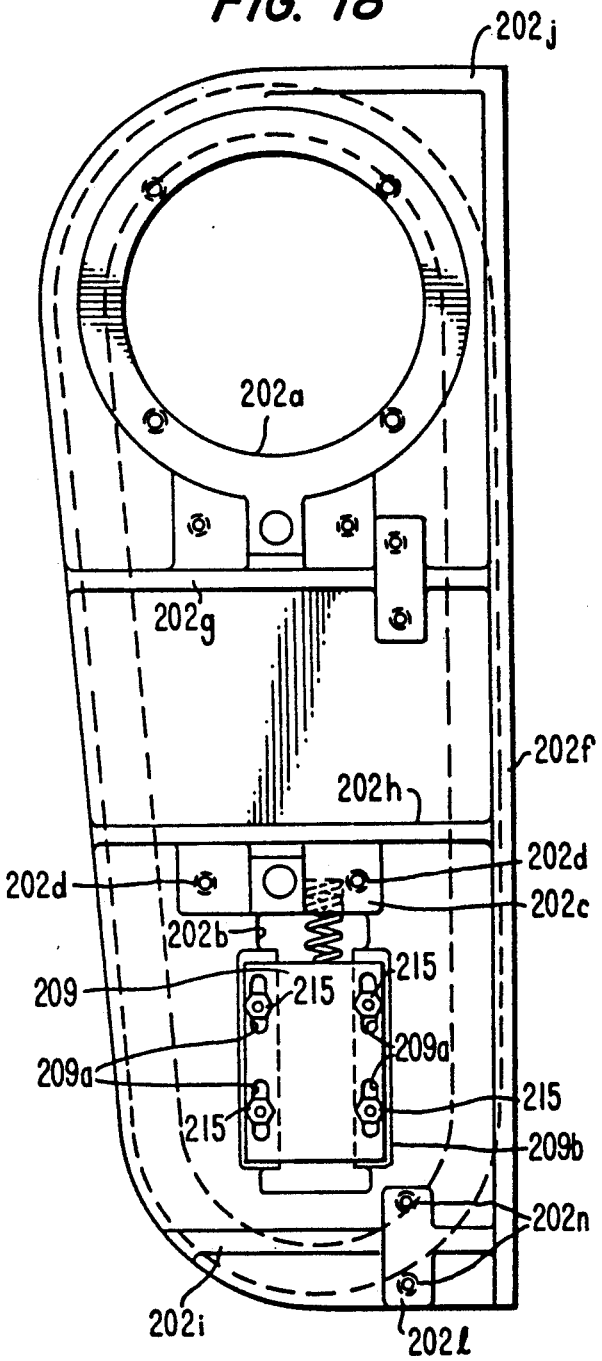
FIG. 18 is a right side elevational view of the right-hand side frame as viewed in FIG. 9 of the stacking section.
Figure 19:
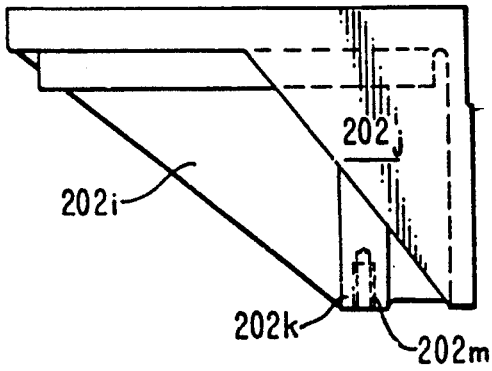
FIG. 19 shows a top view of the stacking section right-hand side frame of FIGS. 16 through 18.

Left-hand and right-hand side frames 201 and 202 both have an elongated substantially I-shaped opening 201*b*, 202*b* (FIGS. 15, 16) for slidably receiving a projecting portion 209*b*, 210*b* of elongated plates 209, 209 (FIGS. 9, 18) each of said plates having an opening for freewheelingly supporting lower movable, sprocket shaft 211 for supporting driven sprockets 212, 212'. Slidable plates 209, 209 are normally urged in a downward direction by helical springs 210, 210 to maintain the drive chains 213 and 214 represented in FIG. 9 by chain lines, under the proper tension. Drive chain 213 is entrained about sprockets 206 and 212 while drive chain 214 is entrained about sprockets 206' and 212'. The downward force exerted upon shaft 211 through slidable members 209, 209 maintains drive chains 213 and 214 under proper tension. This resilient mounting serves an additional important purpose as will be more fully described hereinbelow. FIG. 18 shows one of the plates 209 which is provided with elongated slots 209*a* for receiving securement members 215 which permit slidable movement of plate 209 in I-shaped opening 202*b*. Helical spring 210 normally urges slidable members 209 in the downward vertical direction, urging shaft 211 and hence sprockets 212 and 212' downwardly, together with slidable plates 209, 209. Although not shown for purposes of simplicity, it should be understood that an opening is provided in portion 202*c* of side frame 202 for receiving the upper end of helical spring 210 and that a similar opening is provided in the upper end of plate 209 for receiving the lower end of helical spring 210. Portion 202*c* is further provided with tapped openings 202*d* for receiving threaded fasteners 216 which secure the cast center spacer plate 203 to the side frames 201 and 202.

Main body portion 202*e* of side frame 202 in which openings 202*a* and 202*b*, for example, are provided, is joined to an integral flange portion 202*f* extending in a direction perpendicular to main body portion 202*e*. A plurality of reinforcing ribs 202*g*, 202*h*, 202*i* and 202*j* are mutually perpendicularto main body portion 202*e* and flange 202*f* as well as being integrally joined to main body 202*e* and flange 202*f*.

Portions 202*k* and 202*l* are provided with tapped openings 202*m* and 202*n* which receive threaded fasteners for joining cast side frame 202 to the structural supporting frame of stacker 30 (FIG. 1).

Cast side frames 201 and 202 each have a guide track 201*o*, 202*o* formed by a pair of spaced parallel inner and outer projections 202*p*, 202*q* forming a continuous guide track of substantially oval or racetrack shapes. Tracks 201*o* and 202*o* of side plates 201 and 202 face one another in order to slidably receive and guide the signature supports 220 shown in FIGS. 8 and 10.

Figure 10:
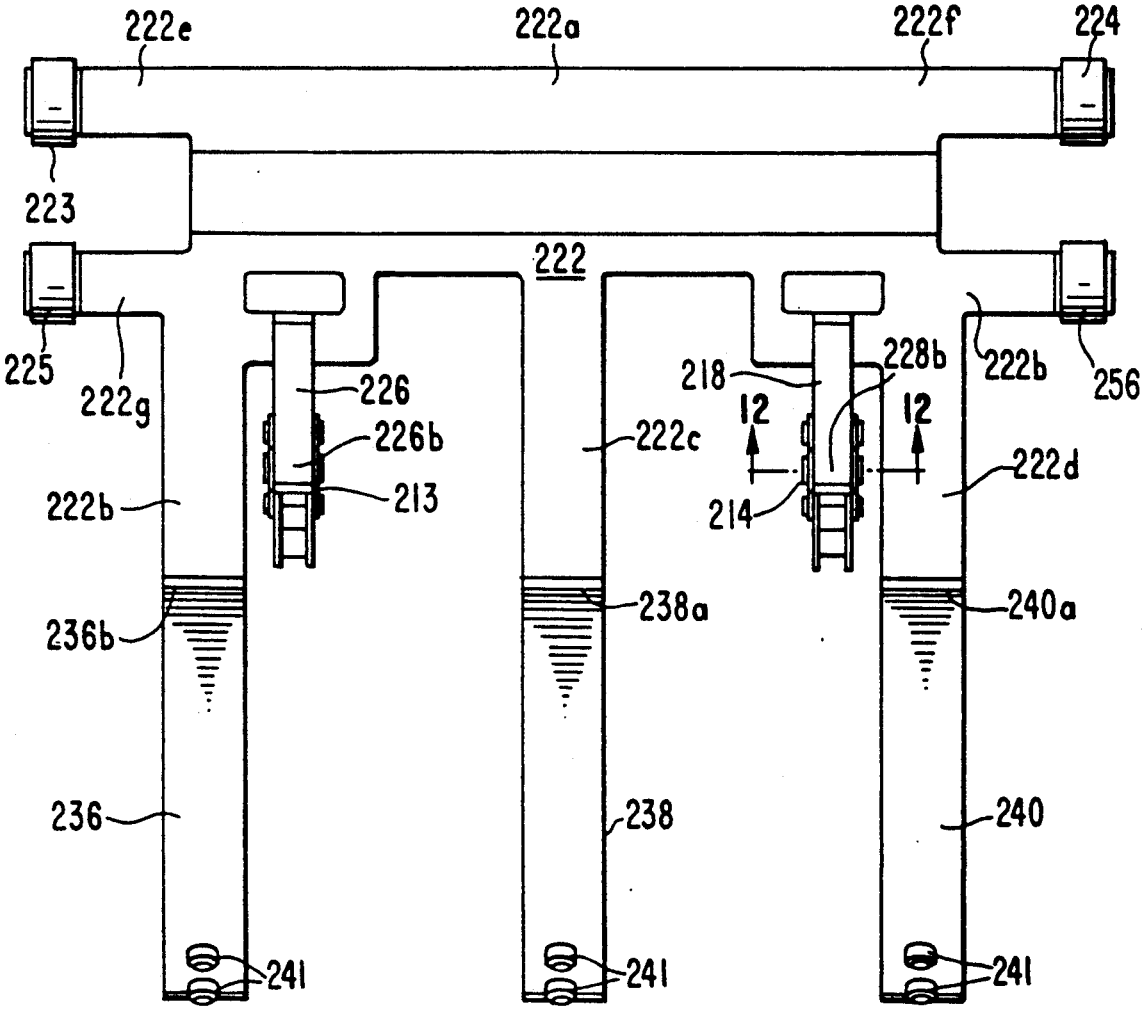
FIG. 10 shows a rear elevation view of one of the stacking supports of FIG. 8.

FIG. 10 shows a front elevational view of one signature carrier 220 which comprises cast member 222 having a substantially E-shaped configuration which may be characterized as comprising a central or yoke portion 222*a* and three downwardly depending integral arms 222*b*, 222*c*, and 222*d*. Central portion 222*a* has two outwardly extending projections 222*e*, 222*f* each of which freewheelingly supports a roller 223, 224. The upper ends of integral arms 222*b* and 222*d* have outwardly extending integral projections 222*g*, 222*h* each of which freewheelingly supports a roller 225, 256. Rollers 224 and 256 ride in the track 202*o* of side frame 202, while rollers 223 and 225 are rollingly supported within guide track 201*o* of side frame 201. These guide tracks serve to guide each signature carrier along a precise guide path regardless of any play which may exist between the carrier and the drive chains 213 and 214 or due to stretching of the drive chains.

Each signature carrier 220 is secured to both drive chains 214, 213 by means of a pair of arms 226, 228. One of arms 226 is shown in the sectional view of FIG. 11 as having an opening 226*a* for receiving pin 227 mounted within an elongated opening 222*i* in member 222 near the upper end of integral arm 222*b*. Rollers 223 and 225 are mounted in a similar fashion in that both rollers are freewheeling mounted upon pins 223*a*, 225*a* arranged within elongated openings 222*j*, 222*k* within main body portion 222*a*. pins 227, 223*a*, and 225*a* are maintained within their respective openings by set screws 258 which threadedly engage openings within the body of member 222, which openings communicate with elongated openings 222*i*, 222*j*, and 222*k*, respectively. It should be understood that arm 228 is mounted in a similar fashion.

The opposite ends of arms 226 and 228 are provided with an opening 226*b*, 228*b* (FIGS. 8, 10), for receiving a pin 230 (FIG. 12) which locks the arms 231*a*, 232*a* of a pair of T-shaped links 231, 232 whose main portion is provided with openings for receiving pins 233, 234 (FIG. 8) which couple the pair of T-shaped links to adjacent pairs of links 214*a*, 214*b* of drive chain 214. The coupling between arm 226 and drive chain 213 is substantially identical in both design and function to that described above. The swingable movement of arms 226, 228 allows the arms to follow any lateral movement of the coupling links 231, 232 which may occur due to any sudden pulling or jerking of the drive chains, without in any way causing the signature carrier 220 to deviate from the closed loop travel path defined by the guide tracks 201*o*, 202*o* of the cast side frames 201 and 202.

Three elongated tapered support members (i.e., "tines") 236, 238, and 240 (FIG. 10) which are of greater thickness at their lower ends and taper to a reduced thickness at their free ends 236*a* and 238*a* and 240*a*, are provided with openings at their lower ends for receiving threaded fasteners 241 to secure the lower ends of support tines 236, 238, and 240 to the free ends of integral downwardly depending arms 222*b*, 222*c* and 222*d*. The mounting surfaces, such as mounting surface 222*m* and arm of 222*b*, are diagonally aligned to maintain support members 236, 238, and 240 in the angular orientation shown best in FIG. 8.

The signature supports are arranged at spaced intervals about drive chains 213 and 214. Noting FIG. 8, signature support 220 is shown in substantially the intercept ready position, to be more fully described. For purposes of the present description it is sufficient to understand that the bottom surfaces of tines 236, 238, and 240 are located just above the top surfaces of the signatures being delivered to the signature support 220' presently receiving said signatures so that when the number of signatures delivered to signature support 220' reaches the desired count, the drive chains 213, 214 drive all of the signature carriers 220, 220', 220'' and 220''' in the direction shown by arrows A2 to cause the free ends of tines 236, 238, and 240 to move just below the first signature to be stacked upon signature carrier 220 to initiate the accumulation of a new stack of signatures. Drive chains 213 and 214 are accelerated by an amount sufficient to assure that the first signature of the next stack of signatures to be accumulated will be collected upon stacking tines 236, 238, and 240.

Figures 8, 11, 12:
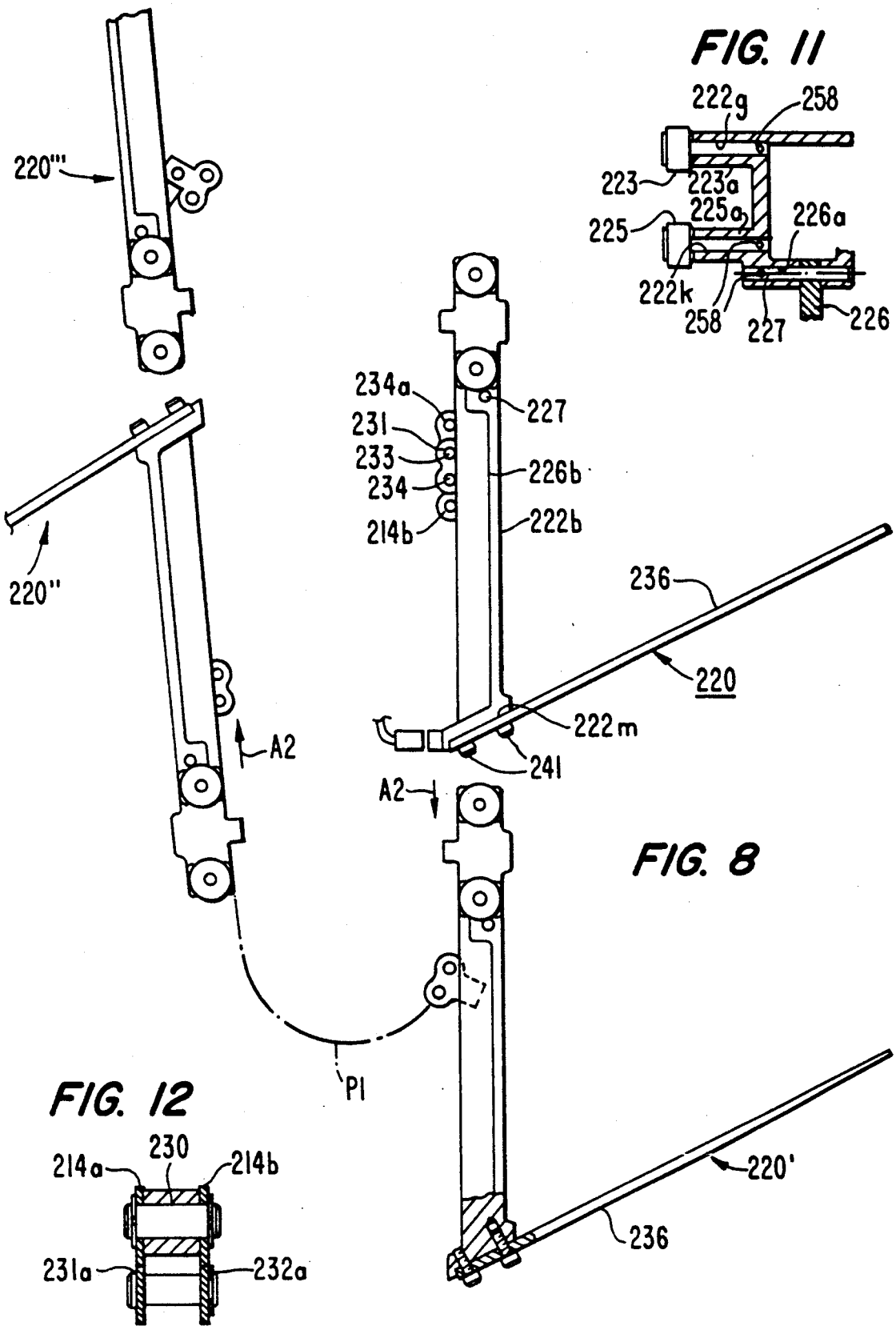
FIG. 8 is a simplified fragmentary right side elevational view of the stacker of FIG. 1 illustrating signature supports and drive chain employed in the stacking section thereof in accordance with the present preferred embodiment of the present invention.
FIG. 11 shows a sectional view of the cam follower rollers and pivotally mounted coupling arm forming part of the stacking support of FIG. 10.
FIG. 12 shows a sectional view taken along the lines 12—12 of FIG. 10.

Ultimately, signature support 220 moves downwardly toward the position occupied by signature support 220' in FIG. 8. At this time, the signature support 220''' will thus be near the intercept ready position and will ultimately intercept the signature stream upon being accelerated, whereupon the precise , number of signatures to be collected on signature support 220''' will be stacked upon support 220'''. At this time, signature support 220' will be swung about the lower curved portion P1 of the path of movement causing the tines 236, 238, and 240 to effectively rotate in a clockwise direction. The radius of curvature of the lower path portion Pl is such that once the supports 236, 238, and 240 reach a horizontal orientation, they will begin to move away from the stack of signatures more rapidly than the stack of signatures will fall due to gravity, enabling the stack of signatures of a precise count to experience a free fall and be dropped upon and thereby collected upon stacking surface 302 of turntable assembly 300. Encoder 208*c* generates pulses representing the movement of the signature carriers 220. Each tine of carrier 220 has a projection 222*n* (FIG. 8) which cooperates with sensor S4 to reset the encoder pulses counted upon completion of passage of each tine carrier as it moves about the guide path.

Figure 20:
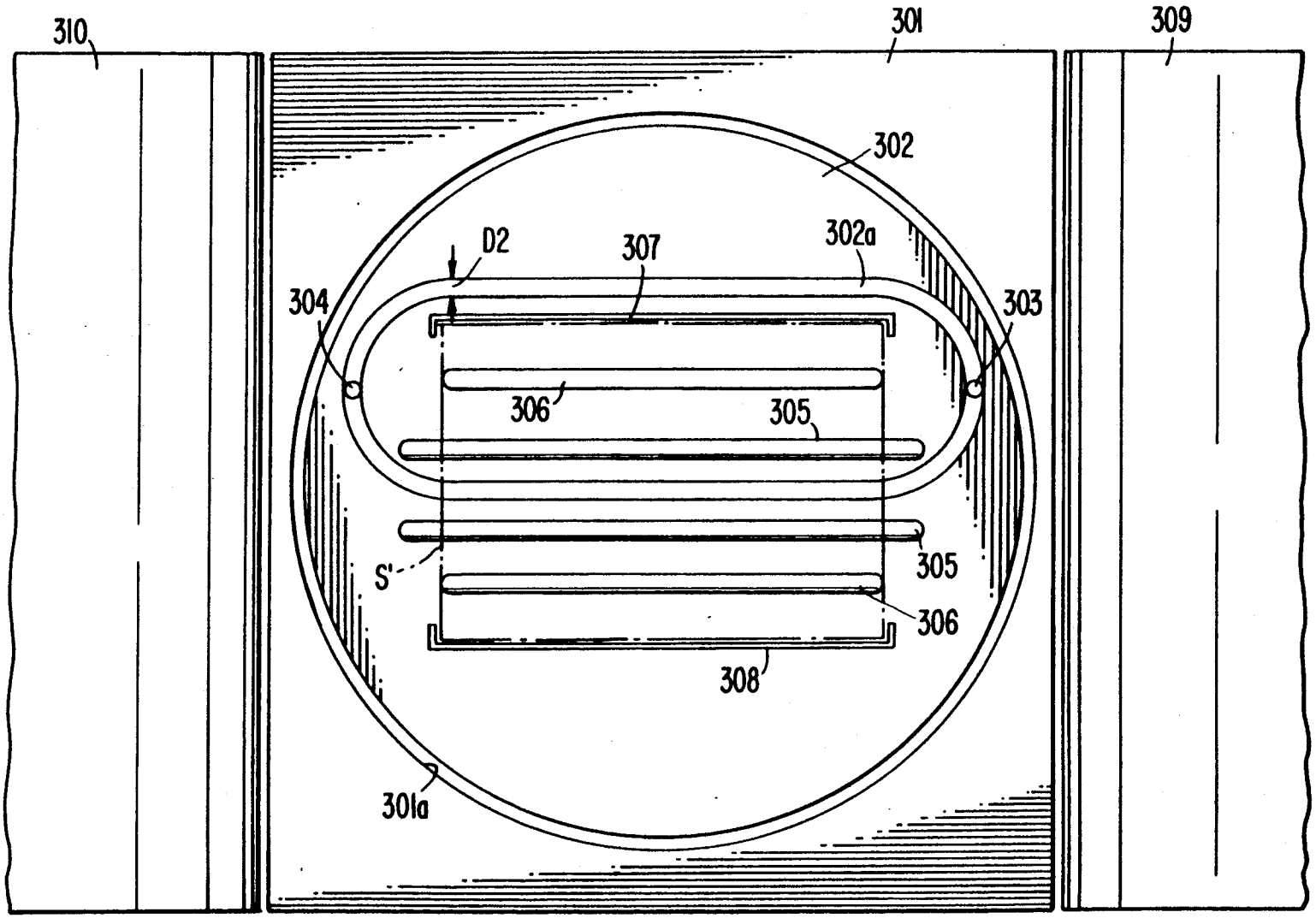
FIG. 20 is a top plan view of the turntable section employed in the stacker of FIG. 1 according to the present preferred embodiment of the invention.

Turntable assembly 300 is shown in detail in FIGS. 20 through 24 and, as shown in FIG. 20, comprises a substantially rectangular surface 301 with a circular opening 301*a* in which rotatable turntable surface 302 is mounted so that the surfaces of members 301 and 302 are substantially flush with one another. Turntable 302 is provided with an oval-shaped opening 302*a* through which a pair of elongated pusher rods 303 and 304 extend. Oval or racetrack-shaped opening 302*a* is sealed with a substantially moving seal assembly to be more fully described for purposes of preventing dust, dirt, lint, or paper from the signatures being handled, or other foreign matter, from passing through slot 302*a* and accumulating upon the mechanisms provided beneath turntable 302.

Turntable 302 is further provided with a pair of elongated, spaced parallel projections 305, 305 arranged substantially equidistant from an imaginary diameter of turntable 302. A pair of shorter spaced parallel projections 306, 306 are arranged upon turntable 302 and in spaced parallel fashion with projections 305. Elongated projections 305, 305 and 306, 306 serve the dual functions of supporting the bottom signature in a stack a spaced distance above slot 302*a* to prevent the signature or any portion thereof from becoming wedged within slot 302*a* as either pusher bar 303 or 304 pushes the stack of signatures off of the turntable, in a manner to be more fully described, as well as allowing the bottom of the stack of signatures to settle faster upon the turntable by providing adequate space for the air beneath the bottom signature to move out from beneath the bottom signature. Such projections 305 and 306 may be in the form of spaced corrugations to relieve the area therebetween.

Turntable 302 is also provided with a pair of vertically aligned guides 307, 308 which serve to guide a stack of signatures dropped upon turntable 302 so that the stack of signatures occupy the position shown by the dotted rectangle S' (FIG. 20) which represents a plan view of the stack of signatures upon the turntable.

Although not shown in detail for purposes of simplicity, the stacker may cooperate with take-off conveyor assemblies 310, 309 which may be roller conveyor assemblies each comprises a plurality of spaced parallel freewheelingly mounted elongated rollers for delivering a stack of signatures either toward the left or toward the right for subsequent handling such as, for example, the wrapping of each completed bundle.

Turntable assembly 300 of the present invention is provided for the purpose of forming compensated bundles. Briefly, compensated bundles are formed by delivering a first stack of signatures to turntable 302; rotating the turntable through a 180 degree angle and then delivering a second stack thereto. The advantage of this compensated bundle arrangement is that the folded edges of signatures have a greater thickness than the cut edges. In a stack of signatures of significant height such as 40 in number, this increased thickness has a cummulative effect causing the completed bundle to be significantly higher along the folded edges of the signatures than along the cut edges. This bundle, which is difficult to handle, may be made more even in height by forming the bundle so that 20 of the signatures have their folded edges along the opposite parallel sides of the completed bundle, hence the name "compensated bundle." Of course, the compensated bundle may comprise more than two signature stacks if desired.

Once the compensated bundle is formed, it is then necessary to remove the bundle from the turntable assembly in order to handle the next compensated (or uncompensated) bundle. This is accomplished by one of the pusher rods 303 and 304 as will be more fully described hereinbelow.

Figure 21:
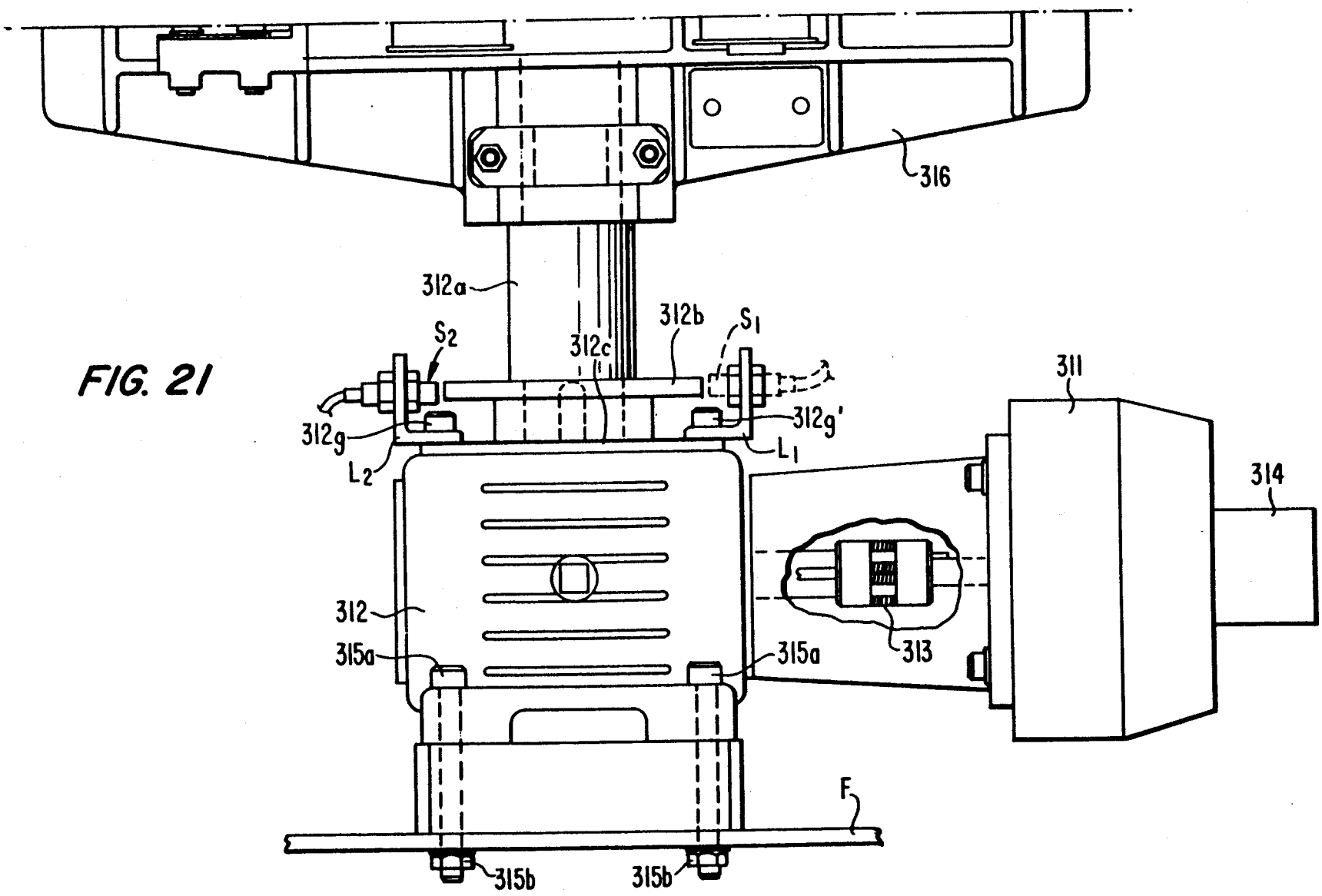
FIG. 21 is a fragmentary elevational view illustrating the turntable drive assembly employed in the turntable section of FIG. 1.

FIG. 21 shows an elevational view of the lower half of turntable assembly 300 which comprises a motor 311 coupled to a gear reducer 312 through a coupler assembly 313. Gear reducer 312 is mounted upon suitable horizontal frame members F of the stacker receiving support frame by means of elongated bolts 315*a* and cooperating nuts 315*b*. An encoder 314 is coupled to motor 311 and is employed by controller 400 to accurately control the operation of motor 311 to move turntable 302 through one-half revolution.

Figure 22:
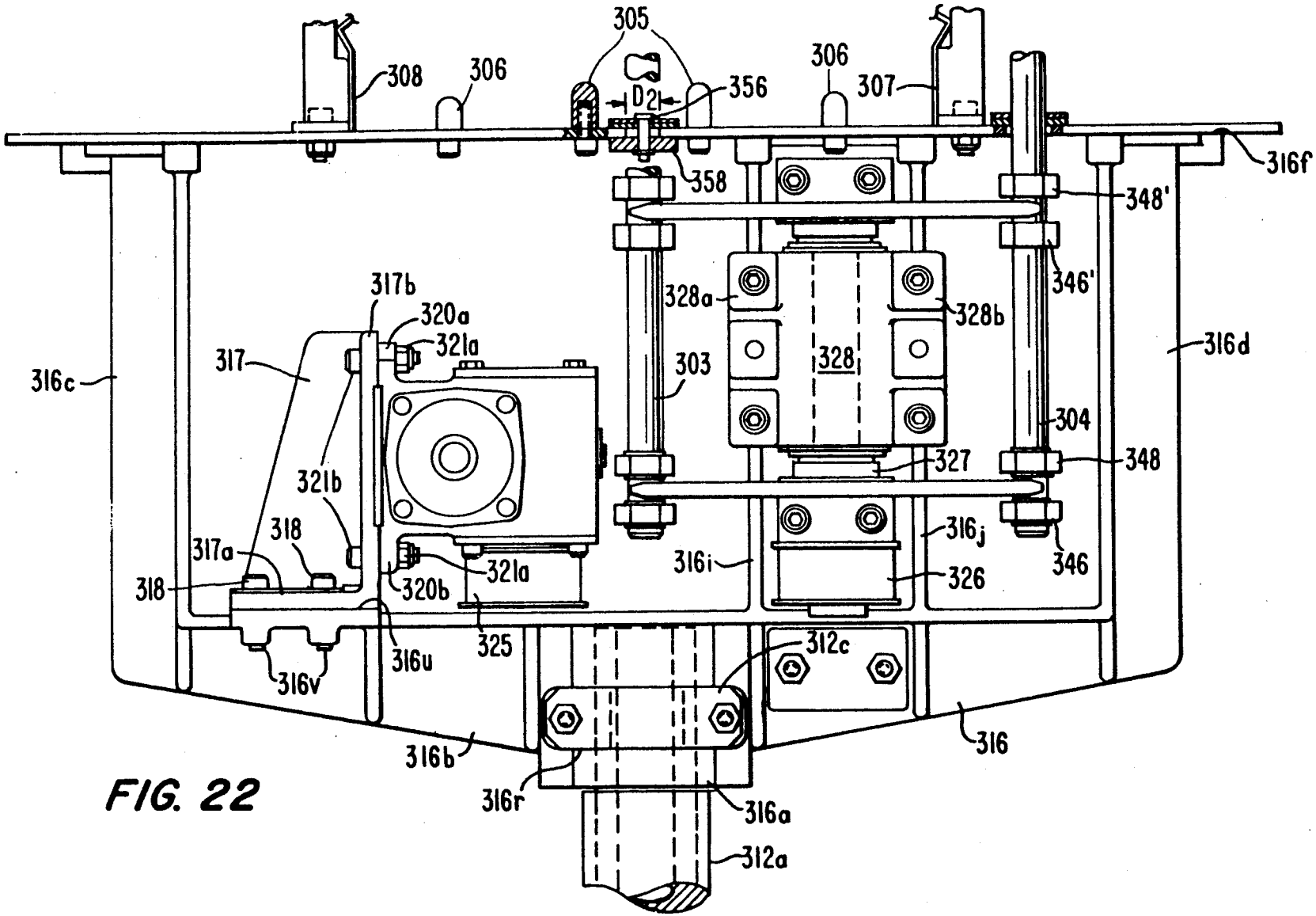
FIG. 22 is a fragmentary elevational view illustrating the push rod drive and moving seal assembly employed in the turntable assembly of the stacker shown in FIG. 1 in accordance with the present preferred embodiment of the invention.

A vertically aligned shaft 312*a* forming a part of and rotated by gear reducing mechanism 312 extends vertically upward to support a casting 316, the lower portion of which is shown in FIG. 21 and the entire casting 316 being shown in FIG. 22. Casting 316 is provided with a downwardly extending collar portion 316*a* which receives the upper end of shaft 312*a*. A strap 312*c* fits across a slot 316*r* in collar portion 316*a* and engages a flat provided at the upper end of shaft 312*a*, providing a zero clearance coupling between shaft 312*a* and collar 316*a*. Casting 316 is generally U-shaped and comprises a yoke or central portion 316*b* and upwardly extending vertically aligned integral arms 316*c*, 316*d* whose upper ends are provided with substantially triangular-shaped mounting surfaces 316*e*, 316*f* (FIG. 23) each having tapped openings 316*g*, 316*h* for receiving threaded fasteners for mounting turntable 302 thereto.

Figure 27:
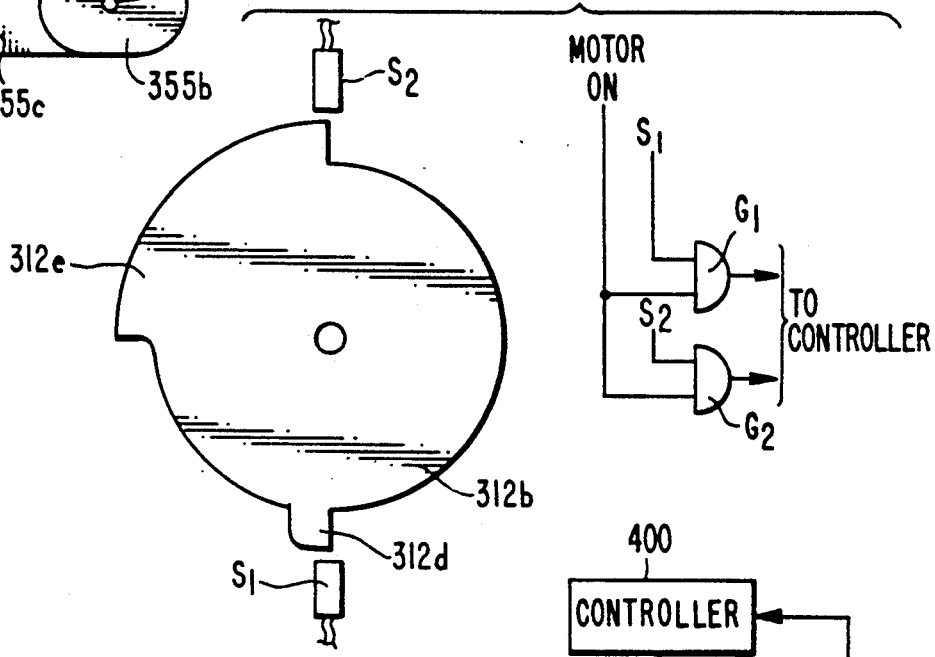
FIG. 27 shows a schematic top plan view of the cam, cam sensors and associated circuitry of the turntable section of FIG. 20 in accordance with the present preferred embodiment of the invention.

A cam 312*b* is secured to the gear reducer output shaft 312*a* to rotate with the shaft (FIG. 21). Proximity sensors S1 and S2 are mounted to the top of the gear reducer housing by angle arms L1 and L2 and fasteners 312*g*. As shown in FIG. 27, cam 312*b* has one very short lobe 312*d* forming an angle of only several degrees and a much larger lobe 312*e* forming an angle of approximately 90 degrees. Sensors S1 and S2 are arranged to lie generally upon an imaginary diameter of cam 312*b*. The output signals from the proximity switches are [ANDed] with the motor on signal by gates G1 and G2. The simultaneous presence of both signals indicates proper alignment of cam 312*b* and hence turntable 302. As the turntable begins to rotate, the signal developed by the sensor (S1) adjacent to short lobe 312*d* drops out first, which is an indication of the direction of movement of both 312*b* and hence turntable 302. The direction signal enables the controller to reverse the polarity of the drive signal to motor 311 in order to reverse the direction of rotation of turntable 302. The importance of this arrangement is to prevent the turntable from being continuously rotated in the same direction to prevent the electrical leads coupled to the push arm drive motor 323 from being twisted about the turntable assembly.

Casting 316 is further provided with a pair of integral upwardly extending vertical ribs 316*i*, 316*j* (FIG. 22) whose upper ends are joined by a spanning rib 316*s* (FIG. 23) to form a substantially H-shaped mounting surface having threaded openings 316*t* for receiving threaded fasteners for securing turntable 302 thereto.

A supporting bracket 317 has a base portion 317*a* joined to surface 316*u* of cast member 316 by fastening means 318 which threadedly engages tapped opening 316*v*. Mounting bracket 317 is further provided with an integral vertically alinged portion 317*b* and with a pair of trapezoidal-shaped integral ribs 317*c* joined to base 317*a* and vertical, side 317*b* and having trapezoidal shape as shown best in FIGS. 22, 23.

A gear reducer 320 has its mounting flanges 320*a*, 320*b* secured to vertical member 317*b* by fasteners 321*a*, 321*b*. A motor 323 drives gear reducer 320 through a coupling assembly 324. Encoder 322 is coupled to motor 323. Gear reducer 320 has an output shafter 320*c* (FIG. 23) upon which pulley 325 is mounted (FIG. 24). The timing belt 396 is entrained about pulley 325 and driven pulley 326 (FIGS. 22–24) secured to the lower end of shaft 327 which is rotatably mounted within a hollow cylindrical member 328 having mounting flanges 328*a*, 328*b* secured by fasteners 328*c* to the ends of the upper projections 316*k*, and 316*l* and the lower projections 316*m*, 316*n* extending outwardly from the vertical ribs 316*i* and 316*j* of casting 316 and being substantially perpendicular thereto. The opposite ends of upper projections 316*k*, 316*l* and lower projections 316*m* and 316*n* are coupled to the mounting flanges 330*a*, 330*b* of a hollow cylindrical member 330 (FIG. 24) which is substantially the same as hollow cylindrical member 328. Fasteners 331 secure the right-hand ends of four pins 332 slidably arranged within elongated bores 316*o* provided at each of the right-hand ends of upper projections 316*k*, 316*l* and lower projections 316*m*, 316*n* so as to permit movement of cylindrical member 330 relative to the projections 316*k*through 316*n*. A plurality of Belleville washers 333 are mounted on each pin 332 between the right-hands ends of projections 316*k* through 316*n* and the adjacent surfaces of the mounting flanges 330*a*, 330*b* to urge cylindrical member 330 away from projections 316*k* through 316*n* for maintaining both upper drive chain 334 and lower drive chain 335 under proper tension, as will be more fully described.

Hollow cylindrical member 330 rotatably supports shaft 336 having upper sprocket 337 and lower sprocket 338 secured to shaft 336 by coupling assemblies 339, 340. For purposes of the present invention it is sufficient to understand that coupling assemblies 339 and 340 may comprise zero clearance coupling assemblies which rigidly secure sprockets 337 and 338 to shaft 336 and which prevent any slippage therebetween. These coupling assemblies are extremely effective in coupling a plastic sprocket to a metal shaft, for example.

In a similar manner, hollow cylindrical member 328 rotatably supports shaft 327 which in turn has upper sprocket 341 and lower sprocket 342 secured to shaft 327 by similar zero clearance coupling asseblies 343 and 344.

Upper drive chain 334 is entrained about upper sprockets 337 and 341 whicle lower drive chain 335 is entrained about lower sprockets 338 and 342. Pulley 326 rotates shaft 327 which in turn rotates sprockets 341 and 342, sprockets 337 and 338 being driven by drive chains 334 and 335 when the drive chains are maintained under proper tension by the Belleville washer assemblies 333 described hereinabove. Although Belleville washers are utilized in the preferred embodiment, it should be understood that any suitable resilient means such as helical springs, resilient compressible rubber-like members or the like, may be utilized.

The upper and lower drive chains 334 and 335 cooperatively support each of the push rods 303 and 304 as is described hereinbelow.

Each drive chain comprises a plurality of pairs of links. For example, drive chain 335 includes a first of such pair of links 335*a* and 335*b* coupled to an adjacent pair of links 335*c*, 335*d* arranged to the right of links 335*a* and 335*b* (FIG. 24). The two aforementioned pairs of links are joined together by pin 335*e*. A roller 335*f* is also mounted upon pin 335*e* and is arranged between links 335*c* 335*d*. All of the remainig links, rollers and pins are joined to one another in a similar fashion.

Noting push rod 303, the lower end thereof has swingably mounted thereto four links which in turn comprise a pair of lower links 346, 347 and a pair of upper links 348, 349. Link 348, for example, has a large diameter portion 348*a* with an opening for receiving push rod 303 and a small diameter portion 348*b* with an opening for receiving and supporting pin 350. Link 346 is substantially identical to link 348. Link 349 is substantially identical to link 348 except that it is turned "upside-down" to provide the arrangement shown best in FIG. 24. Link 347 is substantially identical to 346 except that it is arranged "upside-down" so as to be arranged in a manner shown best in FIG. 24. Actually, all four links are identical and differ only because of their orientation. Links 347 and 349 are joined together by pin 351. Links 349 and 347 are also joined to the left ends of links 335*g*, 335*h* which are substantially identical to links 335*a* and 335*b* except that thse links are bent in a manner shown best in FIG. 24 in order to fit between links 349 and 347 in the manner shown. A roller 335*f* is arranged between links 335*g* and 335*h* and is substantially identical to roller 335*f* described hereinabove. In a similar fashion, the right-hand ends of links 335*c* and 335*d* are joined to links 348 and 346 by pin 350, roller 335*f* being arranged between links 335*c* and 335*d* in the manner shown in FIG. 24.

As was mentioned hereinabove, push rod 303 extends through the large diameter openings in all of the links 346 to 349, said large diameter openings being coalinged. Push rod 303 is retained in position by means of upper and lower C-clips 352, 353. The upper C-clip 352 is shown best in FIG. 23, the lower C-clips being similar in design. The portion 303*a* of push rod 303 is machined to provide a reduced diameter as compared with the remainder of rod 303 and has a plurality of 0-rings 354 surrounding reduced diameter portion 303*a*. The outer diameter of the O-rings 354 is slightly greater than the diameter of the rollers 335*f* to accurately position the push rod 303 throughout the path of movement of the drive chain, thus assuring accurate alignment of the push rod over the entire path of movement. The O-rings reduce the noise caused when the push rod moves between the teeth of a sprocket.

The upper portion of push rod 303 is mounted to upper drive chain 334 in a manner substantially identical to that described hereinabove and provided for the lower portion of push rod 303 wherein links 346' through 349' substantially identical to links 346 through 349 are employed to join push rod 303 to upper drive chain 334. The use of lower and upper drive chains and linkage assemblies 346 through 349 and 346' through 349' assure stable and accurate alignment of push rod 303. Push rod 304 is mounted to upper and lower drive chains 334 and 335 employing linkage assemblies substantially identical to the linkage assemblies 346 through 349 and 346' through 349' described hereinabove.

Figure 23:
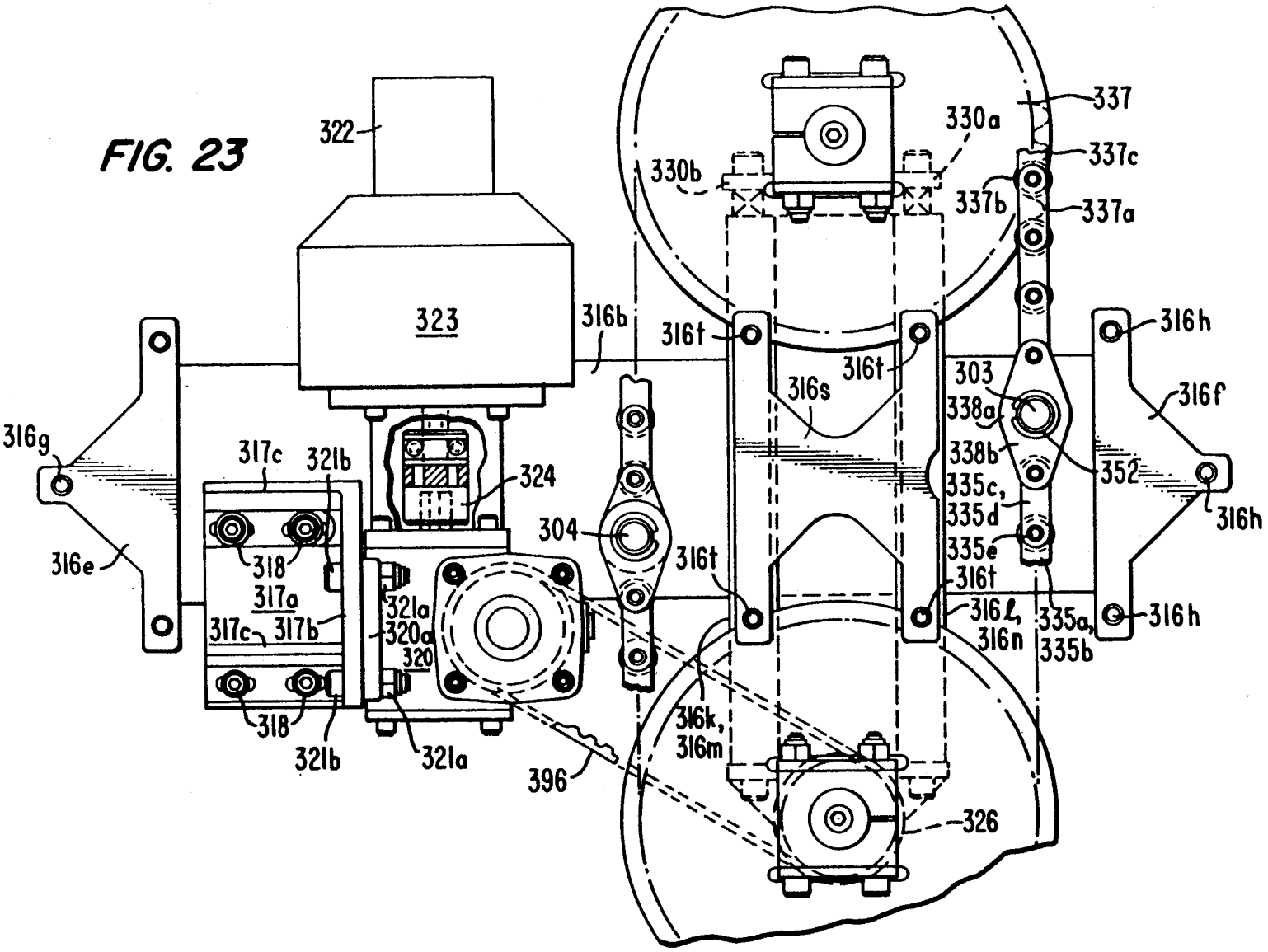
FIG. 23 is a fragmentary top plan view illustrating the push rod drive assembly of FIG. 22.
Figure 24:
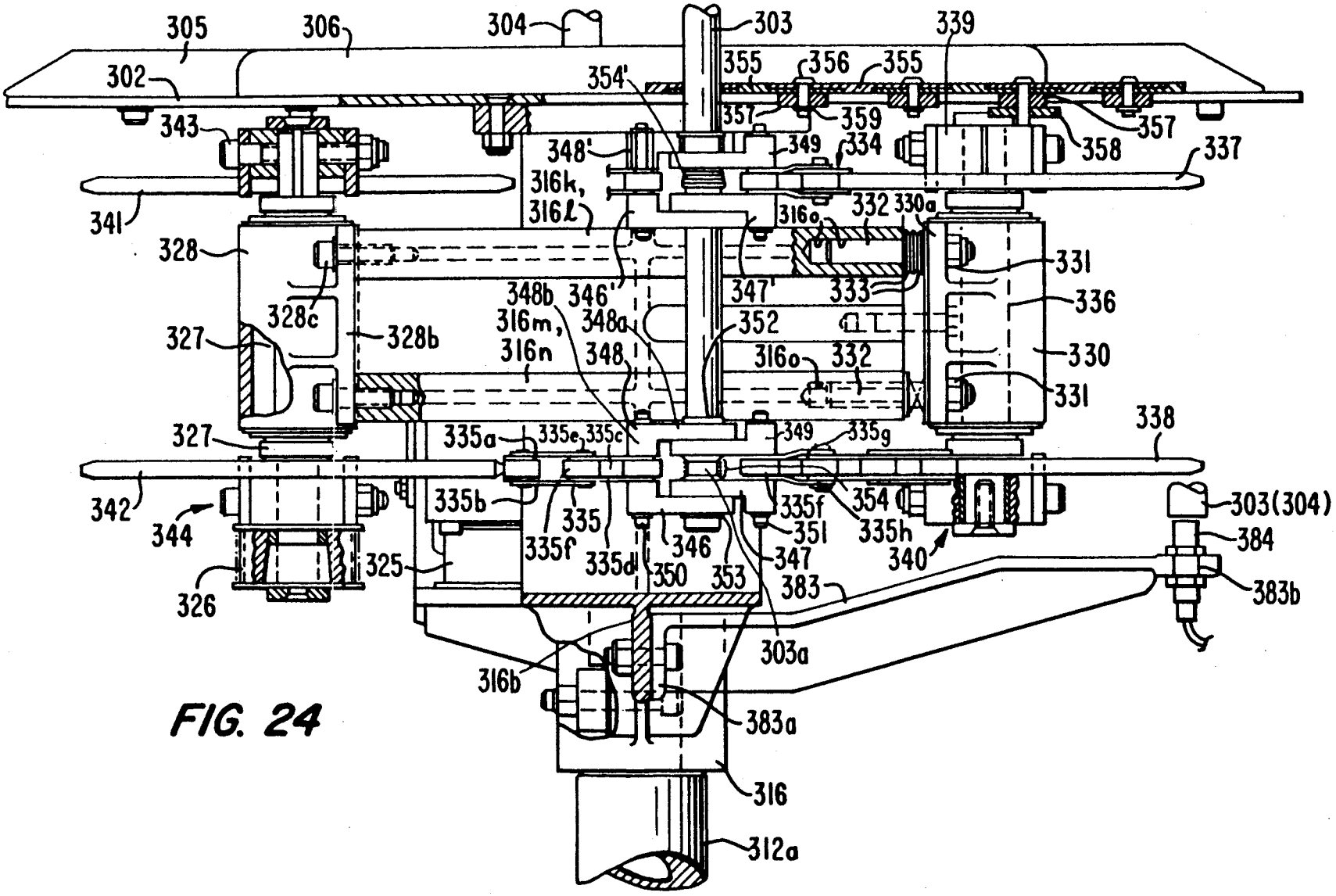
FIG. 24 shows an elevational view, partially sectionalized, of the push rod drive and moving seal assembly of FIGS. 18 and 19 showing further details of the push rod drive assembly.

The rollers 335*f* and O-rings 354 and 354' substantially conform to the semi-circular portions between adjacent teeth of the sprockets such as for example, semi-circular portion 337*b* between teeth 337*a* and 337*c* (FIG. 23). This arrangement assures precise movement of the push rods 303 and 304 about the drive and driven sprocket assemblies 341, 342 and 337, 338, respectively as well as accurate movement of the push rods 303, 304 in the regions between the sprockets.

An elongated arm 383 shown in FIG. 24 has a left-hand end provided with mounting flange 383*a* for securement to mounting portion 316*p*. Arm 383 extends outwardly and to the right of mounting portion 316*p* and is provided with an opening 383*b* at its free end for receiving and supporting proximity switch 384 which detects the passage of the lower end of one of the push rods 303, 304. Proximity switch 384 is preferably a hall effect or other similar sensing device. However, any other type of electrical or inductive or capacitive or optical sensor may be employed if desired.

Figure 25:
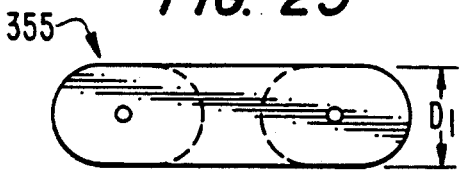
FIGS. 25 and 26 show top and bottom views, respectively, of one of the links employed in the moving seal assembly shown in FIG. 24.
Figure 26:
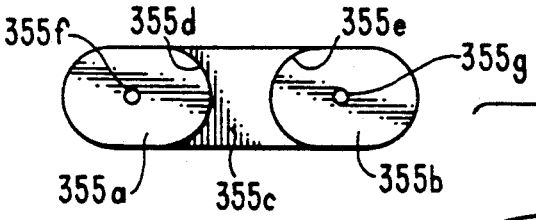

As was described hereinabove, a sliding seal assembly is arranged within oval-shaped slot 302*a* in turntable 302. The moving seal comprises a plurality of links 355, one such link being shown in FIG. 25 as having a width D1 greater than the width D2 of slot 302*a*. Recessed portions 355*a*, 355*b* are formed on one surface of link 355 to form a central portion 355*c* of increased thickness and having oppositely directed semi-circular surfaces 355*d*, 355*e* each of which receives and conforms with the end of an associated link as shown best in FIGS. 24–26. Adjacent links are oriented "upside-down" relative to one another and are joined to one another by means of openings 355*f*, 355*g* whereby the openings of adjacent links are co-aligned so as to receive the connecting pin 356 which also supports a roller 357. Preferably, every third linkage assembly is further provided with a disk 358 of increased diameter, which disk is mounted between a locking clip 359 provided on each connecting pin and a roller 357. However, the rollers 357 may be provided on every pin, every other pin, every fourth pin or every nth pin where n is a real integer greater than one. The disk 358 is positioned beneath slot 302*a* and serves to retain the moving seal with slot 302*a*. Disc 358 has a diameter greater than the width D2 of slot 302*a*. The moving seal is driven about slot 302*a* at at least two points along its length by the push rods 303 and 304 with the moving seal. The links receiving the push rods are provided with enlarged openings. In addition to preventing foreign matter entering into slot 302*a*, the moving seal serves a wiping function which maintains slot 302*a* clean and free of any foreign matter. The links 355 are preferably formed of suitable plastic material having a low coefficient of sliding friction, although any other material may be provided, if desired.

Figure 29A:
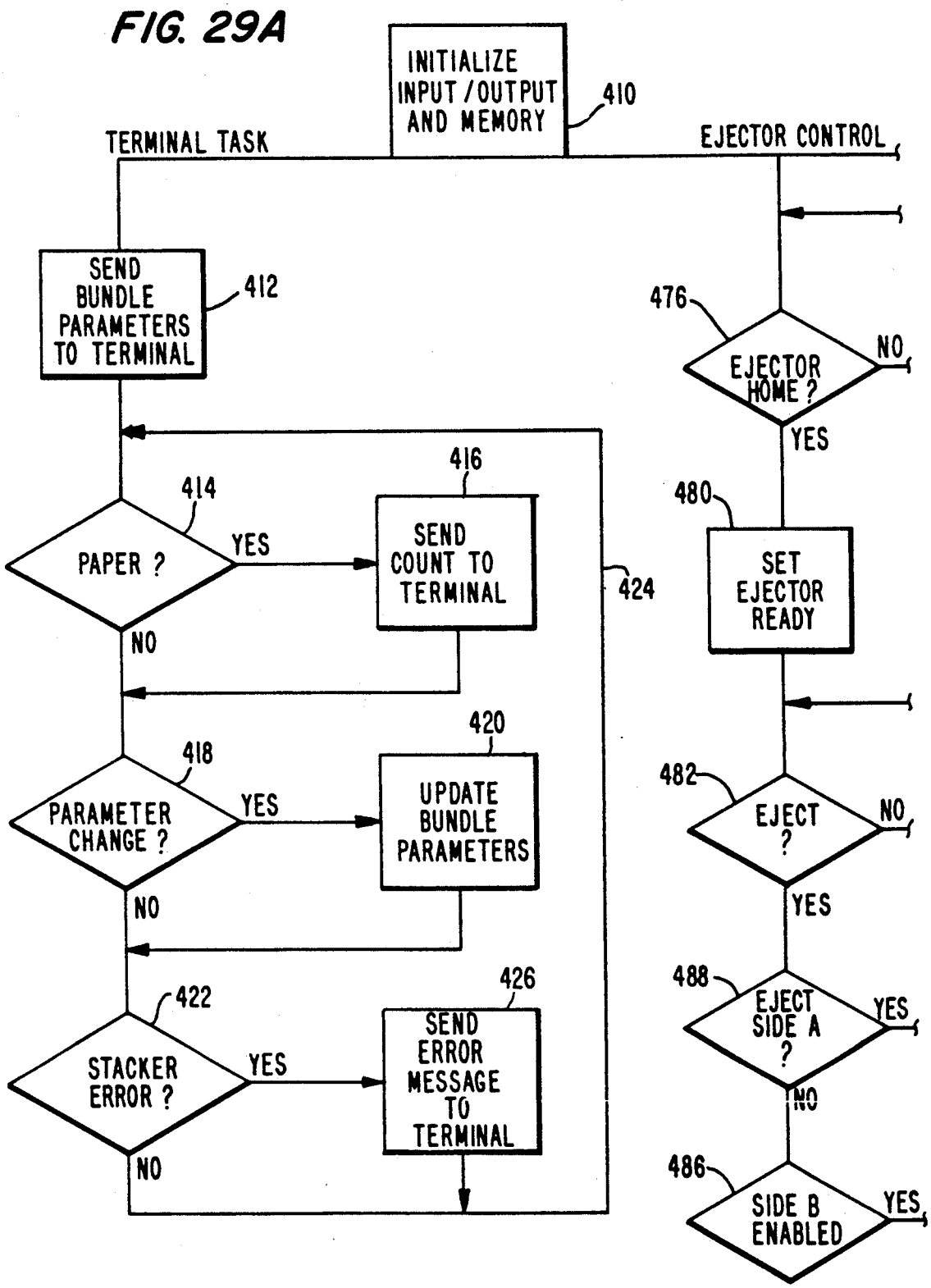

With reference to FIG. 1 and the flow charts in FIGS. 29*a* through 29*c*, the stacker 30 of the present invention operates in the following manner:

Referring to FIG. 29*a*, prior to operation of the stacker 30, the controller 400 is initialized so that all portions of the stacker are in their home position as represented by block 410 of FIG. 29*a*. As shown by block 412 the number of papers, signature thickness, signature separation, signature delivery rate in one or more bundles are input to the terminal. The computer then checks to determine if paper is being processed at desired block 414. If yes, the actual count is sent to the terminal as represented at block 416. If not, a check is made at block 418 to determine if the number of papers is changed. If there has been a change, then the number of papers in a bundle is updated as represented at block 420. If no change or stacker error is indicated at block 422, then the terminal tasks routine is repeated as shown by line 424. If an error exists, the information is sent to the terminal as indicated at block 426.

Signatures enter the infeed section 100 from a press conveyor 32. The infeed section motor 170 is slaved to the operating speed of the press conveyor by coupling the output of the press conveyor tachometer to the motor controller 400. The encoder connected to the infeed section delivers pulses to the controller 400 representative of the speed of movement of signatures through the infeed section.

As the folded leading edge of each signature passes the signature counter, a pulse is generated. This pulse identifies the location of the leading edge of a signature as it passes the signature counter. The knowledge of the geometry of the stacker 30 and the speed of movement of signatures through the infeed section 100 is utilized by the controller 400, together with the pulse from the counter, to determine when the leading edge of a signature, such as, for example, the signature S shown in FIG. 1, will arrive at point P.

Controller 400 operates the stacking section motor 208*b* so that the speed of movement of the signature carriers 220 through 220''' is substantially synchronized with the delivery of signatures thereto.

Figure 29B:
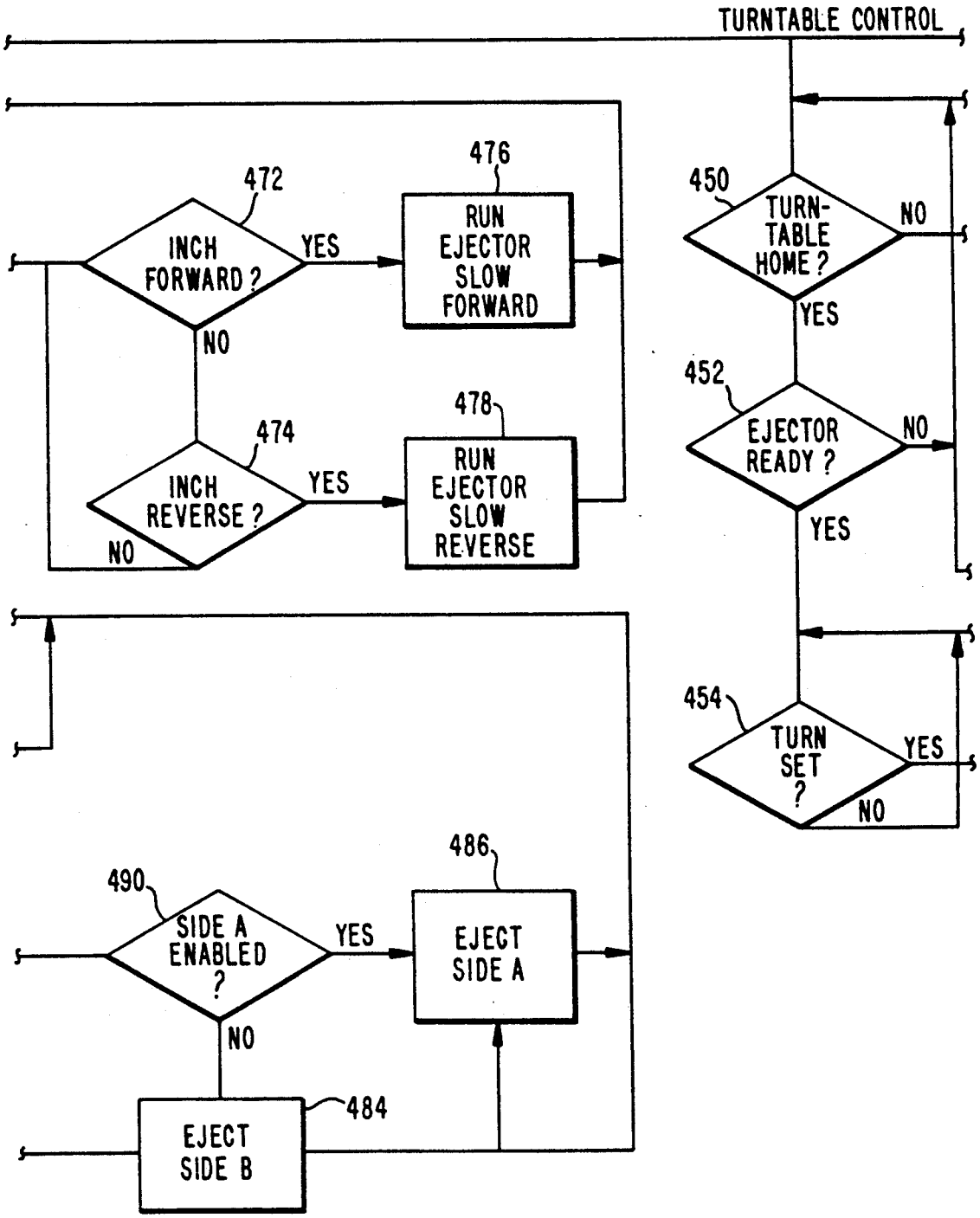
Figure 29C:
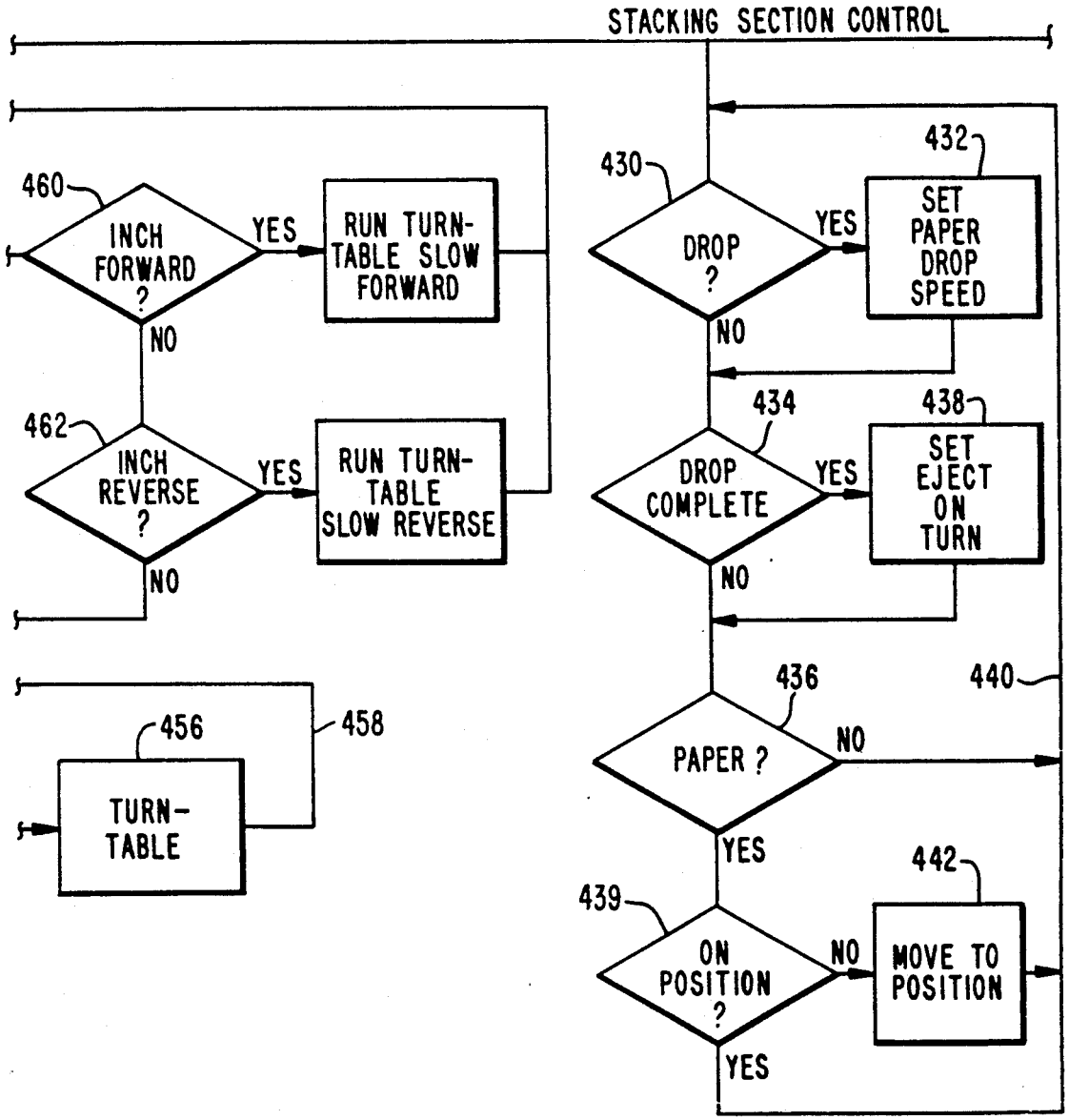

Referring to FIG. 29*c*, the computer determines whether the signature stack is in a drop mode or position at block 430. If yes, the speed of the paper drop is set as previously described and indicated at block 432. If not in the drop position, a check is made at block 434 to determine if the stacking is complete. If not complete, the paper presence is again determined at block 436. If the drop is complete, the eject function or turntable function is commenced as indicated at block 438. If paper is to be stacked, then the position of the paper is checked at block 438. If the paper is in position, then the routine repeats over line 440. If not, the paper is moved to the proper position at block 442.

The stacker frame is shown in dotted fashion in FIG. 1 and supports and aligns the infeed section 100, the stacking section 200, and the turntable section 300 relative to one another. The frame is provided with a plurality of spaced, parallel, vertically aligned members 50 through which the support members 236, 238 and 240 of each signature carrier extend, the spaced parallel members 50 serving as a backing surface which engage the folded edges of the signatures as they are collected. A sensor S4 detects the presence of one of the signature carriers which passes sensor S4 once during each trip about the guide track. Keeping in mind that the signature carriers are moving, controller 400 utilizes the aforesaid information to impart acceleration to the stacking section drive chains and hence to all of the signature carriers, including signature carrier 220, thereby imparting acceleration to signature carrier 220 sufficient to cause it to move beneath signature S to prevent signature S and any further signatures from being delivered to signature carrier 220' and to cause signature S and a predetermined number of signatures following signature S to be delivered to and collected upon signature carrier 220.

The stacking section shaft angle encoder 208c develops pulses responsive to rotation of the stacking section drive shaft to determine the distance traveled by the signature supports. The stacking sensor S4 zeroes the count four times per cycle. Thus, the absolute encoder positively tracks the signature support movement while the sensor S4 zeroes the count four times per revolution to eliminate any missed or extra pulses and hence the cumulative effect thereof. The speed of movement of the signature supports is also altered responsive to any change in the delivery rate of signatures from the press conveyor to stacker 30.

When the next signature support approaches the intercept ready position, and the controller 400, with the aid of the signature counter, has determined that the last signature to be delivered to signature stacker support 220 has passed beneath signature support 220''' (which has reached the intercept ready position), the stacking section drive chains are again accelerated by an amount sufficient to move the support members of signature support 220''' beneath the first signature to be collected thereon to divert the first signature and a predetermined number of following signatures for collection upon signature support 220'''.

At the time that a signature support intercepts the signature stream and begins collectng signatures, the signature support therebelow, such as signature support 220', passes around the stacking section lower sprockets to deliver the stack of signatures downwardly to the turntable assembly 300. The completed stack of signatures moves between the vertical supports 307, 308 and is collected upon the turntable surface 302. Supports 307 and 308 aid in keeping the stack in a neat, upright condition.

The turntable section motor 311 thereafter rotates turntable 302 through 180 degrees. Encoder E1 tracks the rotation of motor 311 and hence the position of the turntable. Cam 312b provides an indication, through sensors S1 and S2, of movement of the turntable and the direction of said movement. The rotation of the turntable is completed prior to delivery of the next completed stack of signatures to the turntable.

Referring to FIG. 29B and 29C, the turntable control first checks the home position of the turntable at block 450. If the turntable is home, the ejector condition is checked at block 452. If the ejector is in the ready position, then, the turntable position is checked at block 454. If the turntable is set, then it is operated at block 456 with the operation being repeated over line 458 until block 454 is in the affirmative to be ready for the ejector. If the turntable is not in the home position, then it is either inched forward or reversed at blocks 460 and 462 to turn the turntable to the proper position and the ejector is ready for operation.

When a compensated bundle of the appropriate number of signature stacks have been collected upon turntable 302, the compensated bundle is pushed off of the turntable 302 by operation of the push rod motor 323 (see FIG. 23) which rotates in a direction according to the side of the stacker to which the bundle is to be dispensed. The push rod motor may be operated to deliver successive bundles to the right side of the turntable, or the left side, or alternatively to the right and left sides, depending upon the application desired by the operator.

Referring to FIG. 29a and 29b, the computer first checks to determine if the ejector is in the home position of block 470. If not, it is inched forward at block 472 or reversed at block 474 to reach the home position through the operation of control blocks 476 or 478. When the ejector is ready as indicated at block 480, the decision to eject is checked at block 482 and the bundle is ejected from either the right side or the left side of the turntable as indicated at blocks 484 and 486 depending on the selection as indicated at decision blocks 488 and 490.

A sensor S5 is utilized to detect jams in the infeed section causing the lower section to swing downwardly in the direction shown by arrow A1 in FIG. 1 by activating the air cylinders to cause signatures delivered to the infeed section 100 to be diverted from the stacking section and to drop harmlessly upon the floor.

Figure 28:
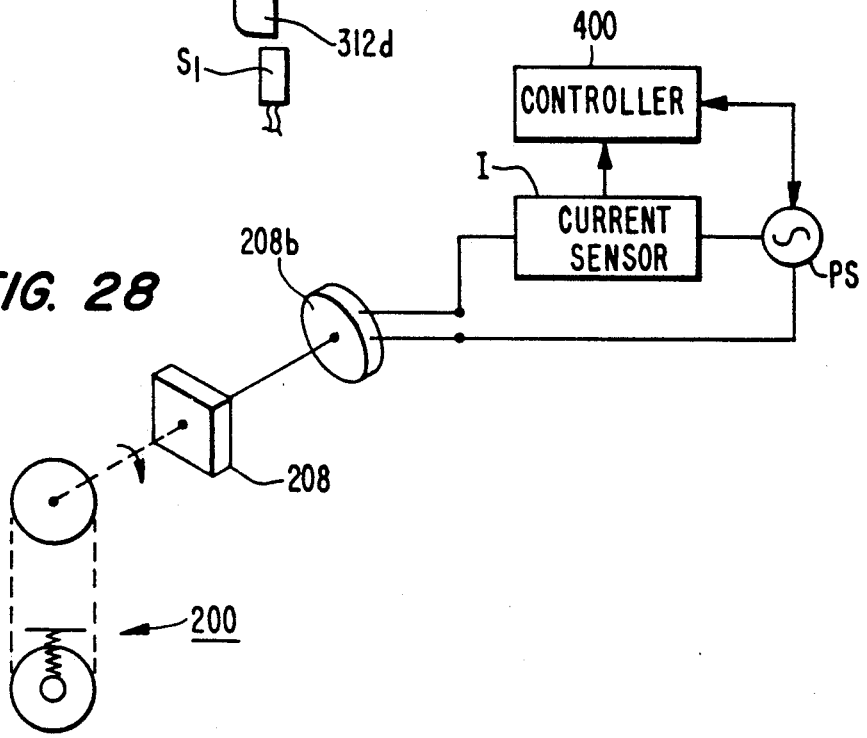
FIG. 28 is a schematic diagram showing a jam sensing circuit according to the present preferred embodiment of the invention, and FIG. 29A through 29C when placed side-by-side, illustrate a computer flow chart showing the steps employed in controlling the stacking section, turntable, and ejector in accordance with the presently preferred embodiment of the invention.

As shown in FIG. 28, the stacking section motor is connected in a circuit including power source PS and a current sensor I. The output of the current sensor I develops an alarm signal when the current delivered to the motor 208b is greater than a predetermined threshold, which signal is applied to the controller 400 when the current reaches an overload condition causing the controller 400 to initially halt the stacking section motor and thereafter cause the motor 208b to operate in the reverse direction for a brief interval. To allow sufficient reaction time to enable the controller 400 to react and to allow motor 208b to abruptly stop and thereafter be driven in a reverse direction for a brief interval, helical springs 210, 210, provided in the stacking section, yield, allowing the shaft 211 to move upwardly toward the fixed stacking section shaft thereby preventing the drive chains 213, 214 from being over-stressed and possibly broken before the stacking section motor can be halted and reversed, which event would occur in the absence of the arrangement provided in the stacking section of the present invention.

The major components of stacker 30 may comprise the equipment and/or devices set forth in the following list and which are presently in the public domain and being offered for sale by their respective manufacturers:

Controller 400 may be a model Z80 microprocessor having 4K battery backed RAM and a 16K ROM having a 24 bit parallel I/O, for example.

Infeed section 100 may employ a Minarik variable frequency controller for operating its three phase AC motor having a 1775 rpm output speed, and the gear reducer may be a conventional model manufactured by Boston Gear, for example. The optical encoder may be that manufactured by PMI Division of Kollmorgan.

The encoder and the stacking section 200 preferably employs a PMI Servodisc d.c. motor, both may be of the type manufactured by the PMI division of Kollmorgan. The sensor may be a conventional ATC proximity switch of the type manufactured by Automatic Timing and Control Company. The gear reducer may be a cone drive gear reducer of the type manufactured by Ex-Cell-O Corporation.

The turntable section 300 preferably employs a PMI motor manufactured by PMI division of Kollmorgan. The gear reducer is preferably a well-known Cone Drive, for example. The proximity sensors and encoders employed in the turntable section 300 may be the same as those employed in the stacking section 200. The motors utilized in the stacking section 200, the turntable section 300, and the ejector section should all be of the type referred to as low armature inversion motors that have extremely rapid acceleration capabilities.

In summary, the method and apparatus for stacking signatures, as previously described in detail in connection with the drawings preferably includes infeed, stacking, and turntable sections of modular design, each being controlled by a dedicated and independent drive means. The present preferred embodiment includes a microprocessor based central controller which continuously monitors all of the aforesaid modular sections to provide control signals generated in accordance with the input information, which often varies, to assure self-adaptive control of the counting and stacking process. More specifically, the method and system provide real time interactive control to start, stop, accelerate, decelerate, and accurately position each of the three (stack section, turntable, and ejector) axes to adapt to the rate of the incoming product.

The infeed section is slaved to the press conveyor which delivers an overlapping signature stream thereto. The infeed section encoder delivers pulses to the controller representative of the infeed conveyor operating speed. Signatures are Veed preferably by cooperating rollers within the infeed section. The cooperating rollers may have differing diameters and be mounted on straight, spaced, parallel shafts to impart the aforesaid V configuration to signatures to stiffen the signatures and thereby facilitate their handling and stacking.

A signature counter generates pulses delivered to the microprocessor-based controller, which signals are utilized to track each signature as it passes the signature counter to determine the time of arrival of the tracked signature at the interrupt-ready position.

A stacking section motor preferably having rapid acceleration and deceleration characteristics drives the stacking section drive chain and hence the plurality of signature supports. A stacking section encoder tracks the signature carrier and utilizes the signature tracking data to coordinate movement of one of the signature carriers with the tracked signatures to assure that the said one of the signature carriers intercepts the signature stream at the proper moment. The signature carrier experiences some acceleration moving from the intercept ready to the intercept position, the magnitude of the acceleration imparted thereto being rather small due to both the continuous movement of the signature support and the continuous adjustment of the signature support velocity responsive to speed changes experienced by the incoming signature stream. Change in the velocity of a signature carrier, which is principally a function of signature thickness, velocity, and nose displacement distance, is chosen to be sufficient to move the tines of the signature carrier adjacent to the intercept ready position just beneath the first signature of the stack to be formed.

Preferably, the signature carriers are pivotally mounted to a drive chain maintained at the proper chain tension by spring means. Cam tracks define the desired path of movement of the signature supports which are pivotally mounted to the drive chain and are provided with cam follower rollers sliding in the cam tracks to assure proper positioning of the signature supports through the stacking region by preventing the positioning of the signature supports from being disadvantageously altered due to the stretching of the chain.

A stacking section sensor which is preferably located at the intercept ready position, resets the accumulated encoder pulse count four times per cycle to prevent the undesirable accumulation of errors in the pulse count.

The load current of the stacking section motor is continuously monitored. A significant change in load current causes the motor to stop and to reverse under the direction of the controller to prevent the mechanism from being damaged. The chain tension springs provide sufficient time before said remedial action to take place by allowing the spring-loaded driven sprocket shaft to move toward the fixed drive sprocket shaft and against the yieldable resiliency of the main tension springs.

The stacks of signatures of a precise count are each delivered to the turntable of a turntable assembly. The turntable assembly comprises a turntable drive motor preferably having rapid acceleration and deceleration capabilities and a gear reducer mechanism for rotating the turntable to form compensated bundles. A two-lobe cam cooperates with a pair of cam sensors to detect both the home position and the direction of movement of the turntable.

A pusher assembly is mounted beneath the turntable for rotation therewith and preferably comprises a drive chain operated by a drive motor which also preferably has rapid acceleration and deceleration capabilities; for moving the drive chain and hence the push rods or ejectors coupled thereto along a substantially oval-shaped or racetrack-shaped path. Linkage members couple the push or ejector rods to the drive chain in such a manner that the push rods move along precisely the same path as the drive chain rollers to simplify the design and to simplify the tracking of the push rods due to their precise positioning. Sensor means senses the initial movement of the push rods as well as sensing the arrival of the push rods at the home position.

The push rods are preferably mounted beneath the turntable and extend through a racetrack-shaped slot for movement therealong. Moving seal means are arranged above said slot and move together with the push rods to prevent dust and the like from entering into the aforesaid racetrack-shaped slot thereby preventing the accumulation of dust or dirt upon the pusher mechanism.

It will be apparent to those skilled in the art that various modifications and variations can be made in the stacking apparatus and method of the present invention without departing from the spirit or scope of the present invention. Thus, it is intended that the present invention cover the modifications and variations of this invention provided they come within the scope of the appended claims and their equivalents.

What is claimed is:

1. A method of stacking signatures comprising:

conveying signatures on an infeed conveyor to an intercept position;

detecting the rate at which the signatures are conveyed on the infeed conveyor;

tracking movement of a signature support of a batcher from an intercept ready position to an intercept position with an encoder; and transporting the signature support of the batcher from the intercept ready position to the intercept position at a speed which adapts to and varies according to variations in the detected rate at which the signatures are conveyed on the infeed conveyor to intercept signatures conveyed from the infeed conveyor.

2. The method of claim 1 including:

transferring at least one batch of signatures from the batcher to a bundler turntable;

rotating the turntable with said at least one batch of signatures at a speed which adapts to and varies according to variations in the detected rate at which the signatures are conveyed on the infeed conveyor; and transferring at least one other batch of signatures to the turntable after rotation of the turntable to form a compensated bundle from the batches of signatures.

3. The method of claim 1 including:

transferring at least one batch of signatures from the batcher to a bundler having an ejector for ejecting a bundle after a predetermined number of batches have been transferred to the bundler; and ejecting the bundle from the bundler by moving the ejector at a speed which adapts to and varies according to variations in the detected rate at which the signatures are conveyed on the infeed conveyor.

4. The method of claim 1 including:

transferring at least one batch of signatures from the batcher to the bundler turntable;

rotating the turntable with said at least one batch of signatures at a speed which adapts to and varies according to variations in the detected rate at which the signatures are conveyed on the infeed conveyor;

transferring at least one other batch of signatures to the turntable after rotation of the turntable to form a compensated bundle from the batches of signatures; and ejecting the compensated bundle from the bundler turntable by moving an ejector at a speed which adapts to and varies according to variations in the detected rate at which the signatures are conveyed on the infeed conveyor.

5. The method of claim 1 wherein:

the transporting step includes driving the signature support of the batcher with a batcher servomotor operated at a speed which adapts to and varies according to variations in the detected rate at which the signatures are conveyed on the infeed conveyor.

6. The method of claim 2 wherein:

the transporting step includes driving the signature support of the batcher with a batcher servomotor operated at a speed which adapts to and varies according to variations in the detected rate at which the signatures are conveyed on the infeed conveyor; and the rotating step includes driving the turntable with a turntable servomotor operated at a speed which adapts to and varies according to variations in the detected rate at which the signatures are conveyed on the infeed conveyor.

7. The method of claim 3 wherein:

the transporting step includes driving the signature support of the batcher with a batcher servomotor operated at a speed which adapts to and varies according to variations in the detected rate at which the signatures are conveyed on the infeed conveyor; and the ejecting step includes driving the ejector with an ejector servomotor operated at a speed which adapts to and varies according to variations in the detected rate at which the signatures are conveyed on the infeed conveyor.

8. The method of claim 4 wherein:

the transporting step includes driving the signature support of the batcher with a batcher servomotor operated at a speed which adapts to and varies according to variations in the detected rate at which the signatures are conveyed on the infeed conveyor;

the rotating step includes driving the turntable with a turntable servomotor operated at a speed which adapts to and varies according to variations in the detected rate at which the signatures are conveyed on the infeed conveyor; and the ejecting step includes driving the ejector with an ejector servomotor operated at a speed which adapts to and varies according to variations in the detected rate at which the signatures are conveyed on the infeed conveyor.

9. The method of claim 5 wherein:

the transporting step includes driving the signature support at all times at a speed which is substantially proportional to the speed of the batcher servomotor.

10. The method of claim 6 wherein:

the transporting step includes driving the signature support at all times at a speed which is substantially proportional to the speed of the batcher servomotor; and the rotating step includes driving the turntable at all times at a speed which is substantially proportional to the speed of the turntable servomotor.

11. The method of claim 7 wherein:

the transporting step includes driving the signature support at all times at a speed which is substantially proportional to the speed of the batcher servomotor; and the ejecting step includes driving the ejector at all times at a speed which is substantially proportional to the speed of the ejector servomotor.

12. The method of claim 8 wherein:

the transporting step includes driving the signature support at all times at a speed which is substantially proportional to the speed of the batcher servomotor;

the rotating step includes driving the turntable at all times at a speed which is substantially proportional to the speed of the turntable servomotor; and the ejecting step includes driving the ejector at all times at a speed which is substantially proportional to the speed of the ejector servomotor.

13. The method of claim 1 including:

generating a signature count by counting each signature as it is conveyed on the infeed conveyor;

detecting the speed of the infeed conveyor; and transporting the signature support at a speed which adapts to and varies according to variations in the signature count and the detected speed of the infeed conveyor.

14. The method of claim 1 including:

conveying signatures on an upstream conveyor upstream of the infeed conveyor;

transferring the signatures from the upstream conveyor to the infeed conveyor;

detecting the speed of the upstream conveyor; and controlling the speed of the infeed conveyor in response to the detected speed of the upstream conveyor.

15. The method of claim 1 wherein the transporting step includes varying the speed of the signature support to reach the intercept position at times when a selected signature to be collected on the signature support reaches the intercept position.

16. The method of claim 1 wherein the transporting step includes accelerating the speed of the signature support as the signature support approaches the intercept position to intercept a selected signature at the intercept position and form a new batch of signatures on the signature support.

17. The method of claim 1 including controlling the speed of the signature support as a function of signature thickness.

18. The method of claim 1 including controlling the speed of the signature support as a function of signature separation on the infeed conveyor.

19. The method of claim 1 including controlling the speed of the signature support as a function of the number of signatures to be formed into a batch.

20. The method of claim 1 including controlling the speed of the signature support as a function of signature thickness, signature separation on the infeed conveyor, and the number of signatures to be formed into a batch.

21. A device for stacking signatures comprising:

infeed conveyor means for conveying signatures to an intercept position;

means for detecting the rate at which the signatures are conveyed on the infeed conveyor means; and batcher means for intercepting signatures conveyed from the infeed conveyor means, the batcher means having signature support means for receiving signatures from the infeed conveyor at the intercept position, means for transporting the signature support means from an intercept ready position to the intercept position at a speed which adapts to and varies according to variations in the detected rate at which the signatures are conveyed on the infeed conveyor means, and for tracking movement of the signature support means from the intercept ready position to the intercept position.

22. The device of claim 21 including:

bundler means having a turntable means for receiving at least one batch of signatures from the batcher means and forming a bundle from said at least one batch of signatures and for compensating the bundle, the bundler means having means for rotating the turntable at a time between receiving two batches and at a speed which adapts to and varies according to variations in the detected rate at which the signatures are conveyed on the infeed conveyor means to form a compensated bundle.

23. The device of claim 21 including:

bundler means for receiving at least one batch of signatures from the batcher means and forming a bundle from said at least one batch of signatures, the bundler means having ejector means for ejecting a bundle after a predetermined number of batches have been transferred to the bundler, and means for moving the ejector means at a speed which adapts to and varies according to variations in the detected rate at which the signatures are conveyed on the infeed conveyor means.

24. The device of claim 21 including:

bundler means having turntable means for receiving at least one batch of signatures from the batcher means and forming a bundle from said at least one batch of signatures and for compensating the bundle, the bundler means having means for rotating the turntable at a time between receiving two batches and at a speed which adapts to and varies according to variations in the detected rate at which the signatures are conveyed on the infeed conveyor means to form a compensated bundle, ejector means for ejecting the compensated bundle from the turntable means, and means for moving the ejector means at a speed which adapts to and varies according to variations in the detected rate at which the signatures are conveyed on the infeed conveyor means.

25. The device of claim 21 wherein:

the means for transporting the signature support means includes batcher servomotor means, operated at a speed which adapts to and varies according to variations in the detected rate at which the signatures are conveyed by the infeed conveyor means, for driving the signature support means.

26. The device of claim 22 wherein:

the means for transporting the signature support means includes batcher servomotor means, operated at a speed which adapts to and varies according to variations in the detected rate at which the signatures are conveyed by the infeed conveyor means, for driving the signature support means; and the means for rotating the turntable includes turntable servomotor means, operated at a speed which adapts to and varies according to variations in the detected rate at which the signatures are conveyed by the infeed conveyor means, for driving the turntable means.

27. The device of claim 23 wherein:

the means for transporting the signature support means includes batcher servomotor means, operated at a speed which adapts to and varies according to variations in the detected rate at which the signatures are conveyed by the infeed conveyor means, for driving the signature support means; and the means for moving the ejector means includes ejector servomotor means, operated at a speed which adapts to and varies according to variations in the detected rate at which the signatures are conveyed by the infeed conveyor means, for driving the ejector means.

28. The device of claim 24 wherein:

the means for transporting the signature support means includes batcher servomotor means, operated at a speed which adapts to and varies according to variations in the detected rate at which the signatures are conveyed by the infeed conveyor means, for driving the signature support means;

the means for moving the ejector means includes ejector servomotor means, operated at a speed which adapts to and varies according to variations in the detected rate at which the signatures are conveyed by the infeed conveyor means, for driving the ejector means; and the means for rotating the turntable includes turntable servomotor means, operated at a speed which adapts to and varies according to variations in the detected rate at which the signatures are conveyed by the infeed conveyor means, for driving the turntable means.

29. The device of claim 25 wherein:

the batcher servomotor means is directly coupled to the signature support means for driving the signature support means at all times at a speed which is substantially proportional to the speed of the batcher servomotor means.

30. The device of claim 26 wherein:

the batcher servomotor means is directly coupled to the signature support means for driving the signature support means at all times at a speed which is substantially proportional to the speed of the batcher servomotor means; and the turntable servomotor means is directly coupled to the turntable for driving the turntable at all times at a speed which is substantially proportional to the speed of the turntable servomotor means.

31. The device of claim 27 wherein:

the batcher servomotor means is directly coupled to the signature support means for driving the signature support means at all times at a speed which is substantially proportional to the speed of the batcher servomotor means; and the ejector servomotor means is directly coupled to the ejector means for driving the ejector means at all times at a speed which is substantially proportional to the speed of the ejector servomotor means.

32. The device of claim 28, wherein:

the batcher servomotor means is directly coupled to the signature support means for driving the signature support means at all times at a speed which is substantially proportional to the speed of the batcher servomotor means;

the ejector servomotor means is directly coupled to the ejector means for driving the ejector means at all times at a speed which is substantially proportional to the speed of the ejector servomotor means; and the turntable servomotor means is directly coupled to the turntable for driving the turntable at all times at a speed which is substantially proportional to the speed of the turntable servomotor means.

33. The device of claim 21 including means for detecting the speed of the infeed conveyor means; and means for generating a signature count by counting each signature as it is conveyed on the infeed conveyor means and for controlling the means for transporting the signature support means to operate at a speed which adapts to and varies according to variations in the signature count and the detected speed of the infeed conveyor means.

34. The device of claim 21 including:

upstream conveyor means upstream of the infeed conveyor means for conveying signatures to the infeed conveyor means;

means for detecting the speed of the upstream conveyor means; and means for controlling the speed of the infeed conveyor means in response to the detected speed of the upstream conveyor means.

35. The device of claim 21 wherein the means for transporting the signature support means includes means for varying the speed of the signature support means to reach the intercept position at times when a selected signature to be collected on the signature support means reaches the intercept position.

36. The device of claim 21 wherein the means for transporting the signature support means includes means for accelerating the speed of the signature support means as the signature support means approaches the intercept position to intercept a selected signature at the intercept position and form a new batch of signatures on the signature support means.

37. The device of claim 21 wherein:

the means for transporting the signature support means includes means for controlling the speed of the signature support means as a function of signature thickness.

38. The device of claim 21 wherein:

the means for transporting the signature support means includes means for controlling the speed of the signature support means as a function of signature separation on the infeed conveyor.

39. The device of claim 21 wherein:

the means for transporting the signature support means includes means for controlling the speed of the signature support means as a function of the number of signatures to be formed into a batch.

40. The device of claim 21 wherein:

the means for transporting the signature support means includes means for controlling the speed of the signature support means as a function of signature thickness, signature separation on the infeed conveyor means, and the number of signatures to be formed into a batch.

41. A method of stacking signatures comprising:

conveying signatures on an infeed conveyor to an intercept position;

driving a signature support of a batcher from an intercept ready position to the intercept position with a servomotor for intercepting signatures conveyed from the infeed conveyor; and tracking movement of the signature support of the batcher from the intercept ready position to the intercept position with an encoder. conveyor.

42. The method of claim 41 wherein the servomotor drives the signature support along a linear path between the intercept ready position and the intercept position.

43. The method of claim 42 including preventing the signature support from rotating during movement from the intercept ready position to the intercept position.

44. The method of claim 42 wherein the linear path is in a direction which is generally vertical and downward.

45. The method of claim 41, including driving the signature support of the batches at all times at a speed which is substantially proportional to the speed of the servomotor.

46. A method of stacking signatures comprising:

conveying signatures on an infeed conveyor to an intercept position;

tracking movement of a signature support of a batcher from an intercept ready position to the intercept position with an encoder;

intercepting signatures conveyed from the infeed conveyor by driving the signature support of the batcher with a servomotor and controlling the velocity and position of the signature support of the batcher from the intercept ready position to the intercept position by controlling the speed of the servomotor; and subsequently driving the signature support with the servomotor for discharging the signatures collected on the signature support.

47. The method of claim 46 wherein the servomotor drives the signature support along a linear path between the intercept ready position and the intercept position.

48. The method of claim 47 including preventing the signature support from rotating during movement from the intercept ready position to the intercept position.

49. The method of claim 47 wherein the linear path is in a direction which is generally vertical and downward.

50. The method of claim 46, including driving the signature support of the batcher at all times at a speed which is substantially proportional to the speed of the servomotor.

51. A method of stacking signatures comprising:

conveying signatures on an infeed conveyor to an intercept position;

detecting the rate at which the signatures are conveyed on the infeed conveyor;

driving a signature support of a batcher with a servomotor throughout an endless path from an intercept ready position to the intercept position where signatures are intercepted by the signature support, from the intercept position to a discharge location where the signatures are discharged from the signature support, and from the discharge location to the intercept ready position;

tracking movement of the signature support of the batcher from the intercept ready position to the intercept position with an encoder connected to the servomotor.

52. The method of claim 51 including controlling the velocity and position of the signature support of the batcher at all times by controlling the speed of the servomotor.

53. The method of claim 51, including driving the signature support of the batcher at all times at a speed which is substantially proportional to the speed of the servomotor.

54. A device for stacking signatures comprising:

infeed conveyor means for conveying signatures to an intercept position; and batcher means for intercepting signatures conveyed from the infeed conveyor means, the batcher means having signature support means for receiving signatures from the infeed conveyor means at the intercept position, batcher servomotor means for driving the signature support means of the batcher means from an intercept ready position to the intercept position, and encoder means for tracking movement of the signature support means from the intercept ready position to the intercept position.

55. The device of claim 54 wherein the servomotor means drives the signature support means along a linear path between the intercept ready position and the intercept position.

56. The device of claim 54 including means for preventing the signature support means from rotating during movement from the intercept ready position to the intercept position.

57. The device of claim 56 wherein the linear path is in a direction which is generally vertical and downward.

58. The device of claim 54 wherein:

the batcher servomotor means is directly coupled to the signature support means for driving the signature support means at all times at a speed which is substantially proportional to the speed of the batcher servomotor means.

59. A device for stacking signatures comprising:

infeed conveyor means for conveying signatures to an intercept position; and batcher means for selectively intercepting signatures conveyed from the infeed conveyor means, said batcher means having signature support means for receiving signatures from the infeed conveyor means at the intercept position, batcher servomotor means for driving the signature support means of the batcher from an intercept ready position to the intercept position by controlling the velocity and position of the signature support means of the batcher means by controlling the speed of the batcher servomotor means, and encoder means for tracking movement of the signature support means from the intercept ready position to the intercept position.

60. The device of claim 59 wherein the servomotor means drives the signature support means along a linear path between the intercept ready position and the intercept position.

61. The device of claim 59 including means for preventing the signature support means from rotating during movement from the intercept ready position to the intercept position.

62. The device of claim 60 wherein the linear path is in a direction which is generally vertical and downward.

63. The device of claim 59, wherein:

the batcher servomotor means is directly coupled to the signature support means for driving the signature support means at all times at a speed which is substantially proportional to the speed of the batcher servomotor means.

64. A device for stacking signatures comprising:

infeed conveyor means for conveying signatures to an intercept position;

detecting means for detecting the rate at which the signatures are conveyed on the infeed conveyor;

servomotor means for driving a signature support of a batcher throughout an endless path from an intercept ready position to the intercept position where signatures are intercepted by the signature support, from the intercept position to a discharge location where the signatures are discharged from the signature support, and from the discharge location to the intercept ready position;

encoder means for tracking movement of the signature support of the batcher from the intercept ready position to the intercept position.

65. The device of claim 64 wherein the speed of the servomotor controls the velocity and position of the signature support of the batcher throughout the endless path.

66. The device of claim 64 wherein:

the batcher servomotor means is directly coupled to the signature support for driving the signature support at all times at a speed which is substantially proportional to the speed of the batcher servomotor means.

* * * * *

UNITED STATES PATENT AND TRADEMARK OFFICE

CERTIFICATE OF CORRECTION

PATENT NO. : 5,024,569

DATED : June 18, 1991

INVENTOR(S) : Leonard A. WATTS and Medardo ESPINOSA

It is certified that error appears in the above-identified patent and that said Letters Patent is hereby corrected as shown below:

Claim 41, column 26, line 32, delete "conveyor."

Signed and Sealed this

First Day of December, 1992

*Attest:*

DOUGLAS B. COMER

*Attesting Officer*

*Acting Commissioner of Patents and Trademarks*